US005860225A

United States Patent [19]

O'Dwyer

[11] Patent Number: 5,860,225

[45] Date of Patent: Jan. 19, 1999

[54] SELF-VENTILATING FOOTWEAR

[75] Inventor: James M. O'Dwyer, Queensland, Australia

[73] Assignee: Breeze Technology, Atlanta, Ga.

[21] Appl. No.: 808,700

[22] Filed: Feb. 28, 1997

Related U.S. Application Data

[63] Continuation-in-part of Ser. No. 418,127, Apr. 6, 1995, Pat. No. 5,606,806, which is a continuation of Ser. No. 48,661, Apr. 16, 1995, abandoned which is a continuation-in-part of PCT/AU92/00554 Oct. 16, 1992.

[51] Int. Cl.[6] ..... A43B 13/20; A43B 7/06

[52] U.S. Cl. ..... 36/27; 36/3 B; 36/35 B; 36/29

[58] Field of Search ..... 36/3 B, 29, 27, 36/28, 35 B, 7.8

[56] References Cited

U.S. PATENT DOCUMENTS

| | | |
|---|---|---|
| 1,638,350 | 8/1927 | Long . |
| 3,377,722 | 4/1968 | Downing . |
| 3,716,930 | 2/1973 | Brabm . |
| 4,342,158 | 8/1982 | McMahon et al. . |
| 4,535,553 | 8/1985 | Derderian et al. . |
| 4,774,774 | 10/1988 | Allen, Jr. . |
| 5,138,776 | 8/1992 | Levin . |
| 5,606,806 | 3/1997 | O'Dwyer . |

*Primary Examiner*—Ted Kavanaugh
*Attorney, Agent, or Firm*—Crowell & Moring LLP

[57] ABSTRACT

An energy-return pump chamber for footwear. A lateral cross-section of the chamber having rigid top and side portions with flexible top and side elbows between. A longitudinal cross-section of the chamber a flat bottom portion, a rear flat horizontal portion of the top and a downward-slanting front portion of the top down to the forward end of the flat bottom.

1 Claim, 20 Drawing Sheets

SELF-VENTILATING FOOTWEAR

The present application is a continuation-in-part of application Ser. No. 08/418,127, filed Apr. 6, 1995, now U.S. Pat. No. 5,606,806, which is a continuation of Ser. No. 08/048, 661, filed Apr. 16, 1993, abandoned which is a continuation-in-part of PCT/AU92/00554, filed Oct. 16, 1992.

BACKGROUND OF THE INVENTION

All of the above applications are incorporated herein by reference.

This invention relates to improvements to footwear.

This invention has particular application to sporting footwear such as sneakers and joggers and hereinafter generally referred to as sneakers but of course it is not limited thereto and can be used in boots, shoes and slippers and the like. However, for illustrative purposes only, particular reference will be made hereinafter to its application to sneakers.

In recent years the construction of sneakers has become very complex with a view to making sneakers comfortable to wear and able to minimize shock loadings placed on the body during active use. In order to achieve the desired results many sophisticated construction techniques and synthetic materials have been utilized in their manufacture. However, despite the sophisticated nature of such footwear there remains room for improvement both in relation to discomfort resulting from shock loadings applied to the user's fee and/or lower limbs, or in relation to discomfort resulting from the user's feet being confined without effective ventilation.

Furthermore, a common problem remains with sneakers and other footwear, namely foot odor resulting from uncomfortably hot conditions. This problem is particularly noticeable in sneakers due to the interaction of foot perspiration with the synthetic materials of the sneakers. This condition is aggravated by the lack of air circulation about the foot and may encourage fungal growth and cause other adverse medical problems for the users.

While arrangements to positively ventilate footwear have been suggested in the past, such as is listed in the International Search Report issued in respect of International Application No. PCT/AU92/00554 from which the present application claims priority, it is considered that the teachings in all the previous art would not enable viable footwear to be provided which would positively ventilate and cool the feet of a user. For this purpose, it is considered that positive ventilation apparatus for footwear needs to be able to work efficiently cycle after cycle, it needs to positively displace air from the footwear and not simply move air around within the footwear, bearing in mind that in use, all footwear contains a relatively constricted free air space about a user's foot within footwear, and footwear utilizing positive ventilation apparatus may be comfortable and supportive in use and able to be cleaned and serviced.

Footwear is also used for activities on cold surfaces and by persons with poor circulation to their extremities including their feet. At present the most common remedy for such conditions is to wear thick socks as insulation against ingress of the cold. This is only partially effective and may cause discomfort to the user.

SUMMARY OF THE INVENTION

The present invention aims to alleviate one or more of the above-mentioned disadvantages and to provide improvements to footwear which will be effective in use.

With the foregoing in view, this invention in one aspect resides broadly in ventilated footwear including:

a resilient sole assembly;

a pumping chamber;

biassing means biassing said pumping chamber to an expanded attitude;

said pumping chamber being substantially contained within the of the sole assembly for cyclic compression by a user's heel and tapering towards and terminating adjacent the lateral extremities of the heel and when compressed having a volume which approaches zero;

an air inlet passage to said pumping chamber extending from air inlets in the sole assembly adjacent to toe region and extending to the pumping chamber where air can be induced to the pumping chamber only from said toe region air inlets;

an air outlet passage from said pumping chamber exhausting to the exterior of the footwear, and respective oppositely arranged non-return valves in said air inlet passage and said air outlet passage and arranged to cause air to be pumped through said pumping changer from said air inlets to said air outlet passage upon cyclic compression or said pumping chamber and said non-return valves being arranged in the arch portion of the sole.

Suitably the non-return valves are disposed in side by side relationship and may be formed as separate releasable inserts or in the form of an assembly of valves in a single releasable insert. Alternatively, the non-return valves may be fixedly located and manually operable to enable water to be drained from the pumping chamber after washing or flooding. Preferably the non-return valves are located at the junction of said air inlet and outlet passages with said pumping chamber.

It is also preferred that the material about the side walls of said pumping chamber is resilient and constitutes said biassing means and that the pumping chamber includes converging upper and lower peripheral wall portions extending from substantially parallel top and bottom chamber walls. The converging upper and lower peripheral walls portions may be formed so that the leading end of said pumping chamber is of a forwardly elongated wedge shape and the back and side portions of the pumping chamber are of a shallow wedge form in traverse section. Furthermore, it is preferred that the thickness of material about the outermost edge of said pumping chamber formed at the intersection of said converging upper and lower peripheral walls is substantially constant.

In a preferred embodiment adapted as an adult running shoe the pumping chamber may be actuated to pump a volume of air between 50 $cm^3$ and 100 $cm^3$ and for example in a size seven shoe of say approximately 75 $cm^3$ or 4½ $in^3$ in active use, which is approximately the volume of air contained between the foot and the inside of the shoe. Alternatively, in an embodiment adapted as an adult walking shoe the pumping chamber may be actuated to pump a volume of air between 25 $cm^3$ and 50 $cm^3$ and for example in a size seven shoe of say approximately 35 $cm^3$ or 2 $in^3$. In the preferred form, the flow of air is maximized around the toe area. In an alternative embodiment, air is drawn from around the heel area prior to circulating to the toes.

In a preferred embodiment, fresh air flow enters at the neck of the shoe and flooding of the pumping chamber is only a problem if the shoe of the preferred embodiment is worn in water having a depth that is greater than the height of the neck of the shoe. Moreover, if the shoe is filled with water, the pumping system may assist in its removal.

In order to minimize the noise levels created by the operation of the valves, and in particular by the exhausting air, the valves are located under a user's foot. Furthermore, all flow restriction in the valves and ducting is minimized. Capping of the exhaust stack with a sound absorbing wad may also be utilized as effective noise muffling as there should be less due noise during the intake cycle due to the lower velocity flow of the incoming air.

In achieving an optimum shoe for a particular purpose according to this invention, consideration may be given to the compromise which must be reached between impact cushioning on the one hand and high air flow volumes on the other. If the exhaust system is restricted, high pressures can be generated in the pumping chamber during the exhaust cycle, as a result of sudden ground impact. The greater the restriction, the higher the compression and impact damping. As the exhaust cycle continues, the release of air into the exhaust duct permits collapsing of the pumping chamber under the weight on and/or momentum transmitted through the user's heel. It follows that the rate of collapse of the pumping chamber may be variable by altering the degree of restriction in the exhaust duct. A predetermined collapse rate may be achieved by providing a control to vary the aperture size of the exhaust duct.

Although there may be advantages in a heel that absorbs impact in such a progressive way, where the invention is directed towards the efficient movement of fresh air through the shoe, that flow is maximized by reducing any restriction. However, the rat of collapse of the pumping chamber, depending on the construction of the pumping chamber, and the force applied thereto, may be provided to ensure the collapse of the pumping chamber is completed in the same period of time that the heel is under pressure (the period the heel is on the ground).

The structural resistance of the pumping chamber to deformation can be varies accordingly. If the deformation resistance is increased, the exhaust restriction that determines the build up of pressure, may be relaxed.

The pumping chamber may be manufactured so that its structural resistance to deformation is the sole means of providing impact cushioning. Flow restrictions could be minimized, and the system would operate at low air pressures. Alternatively, impact resistance could be substantially provided by restricting the exhaust, and reducing the deformation resistance. Operating pressures would be high, and the volume of air pumped may be reduced in comparison to the first alternative.

In a preferred form of the invention, the structural deformation resistance of the pumping chamber should provide most of the impact cushioning. There could be some restriction of the exhaust so that a lesser part of the impact cushioning may be carried by the air pressure in the pumping chamber.

In standard sneakers, energy is partly returned by the compressed cushioning material, or air chamber. However, in the present invention, the air in the collapsing pumping chamber is released, and may provide little or no return energy, and the deformation resistance of the pumping chamber is increased accordingly. In one form, the total depth of cushioning material in the heel is not reduced. In such embodiments, when the pumping chamber collapses under pressure, the remaining energy compresses the cushioning, and allows for energy return.

Suitably restriction on air flow is minimized, bulk around the pumping chamber is minimized, the deformation resistance is provided by the structure of the pumping chamber by either providing the side walls with the requisite deformation resistance, or by providing the pumping chamber with some internal structure.

In another aspect this invention resides broadly in ventilated footwear including:

a resilient sole assembly;

a pumping means having a volume of between one-third to one and one-half times the volume of air contained about a user's foot within the footwear;

biassing means biassing said pumping means to an expanded attitude;

and air inlet passage to said pumping means extending from air inlets in the sole assembly adjacent to the toe region and extending to the pumping means whereby air can be induced to the pumping means only from said toe region air inlets;

an air outlet passage from said pumping means exhausting to the exterior of the footwear, and respective oppositely arranged non-return valves in said air inlet passage and said air outlet passage and arranged to cause air to be pumped through said pumping means from said air inlets to said air outlet passage upon cyclic compression of said pumping means.

The pumping means may be obtained in the toe and/or heel region of the footwear and may be a plurality of pumping chambers. Preferably, however, the pumping means is a pumping chamber substantially confined within the heel of the sole assembly for cyclic compression by a user's heel and tapering towards and terminating adjacent the lateral extremities of the heel and when compressed having a volume which approaches zero.

Preferred embodiments of the invention may be categorized into three broad types. In the first category, hereinafter referred to as a walker, the footwear is a purpose constructed sneaker, in which the major components are contained in a removable insert, and which has the pumping chamber located in the heel. The secondary category hereinafter referred to as a runner, is footwear which is another purpose constructed sneaker, in which all components are integrated into the construction of the sneaker, and in which the valves only, are removable. The third category, hereinafter referred to as day shoes, is footwear with a completely self-contained insert, which include all the working components and the pumping chamber(s). For lesser pumping volumes, the insert may fit into a conventional shoe. For higher pumping volumes, the insert may be par of a purpose built shoe and may further include an optional pumping insert.

Footwear to the invention may have a removable insert including the inlet and exhaust ducting, two flow control valves, an exhaust stack, and a rate of flow switch. The only part of the system not contained in the insert in this embodiment is the pumping chamber, which is preferably located in the heel of the footwear.

All the working parts are contained in the insert which is removable for such purposes as cleaning, repair or replacement. Each of two apertures in a top wall of the pumping chamber receive a respective valve extending from a lower wall of the insert. The valves are preferably press fit items.

When the pumping chamber is compressed, any tendency for the valves to be pushed out of the apertures is overcome by the pressure of the heel being applied at that time. The pumping chamber is located in the heel to give the maximum pumping volume, as might often be required with sneakers. The volume is preferably 74 $cm^3$ or 4½ $in^3$.

The sides of the pumping chamber are preferably shaped to maintain lateral strength during vertical compression and expansion of the pumping chamber. The exhaust stack is preferably located on the inside of the foot for comfort and convenience. While the exhaust is located in the same region as the air entering the neck of the shoe, it is believed that this should not affect the operation of the shoe as the two operations of intake and exhaust take place at different time. Exhaustion of air from the pumping chamber is substantially completed with the shoe contacting the ground, while most of air intake is completed with the shoe lifted from the ground.

In a preferred embodiment, the air inlet is provided under the toes, and the top of the exhaust stack is provided with an air filter. In the heel area, the pumping chamber remains in situ, and is overlaid by the insert. An internal spring may provide the return force for the pumping chamber, in lieu of positively biased pumping chamber walls. However, the spring may prevent the full collapse of the pumping chamber.

In another preferred form of walker, a stiffened base under the heel of the footwear transmits impact pressure to the sides of the shoe. The sides of the pumping chamber transmit this pressure to the ground, and are constructed of material of suitable strength and resilience.

In an alternative preferred embodiment to the embodiment the footwear is a purpose constructed sneaker with all parts constructed as part of the sneaker, and the valves being the only removable component, described above as the runner.

In this embodiment, the inlet ducting is contained in the sole of the shoe. The pumping chamber remains located in the heel, and the available pumping volume remains in the range of from 50 $cm^3$ to 100 $cm^3$ (3 $in^3$ to 6 in3). The exhaust stack is located in front of the inside ankle, and is structured to be a permanent fixture, such as by making the exhaust stack part of the upper of the shoe.

A small insert, or plug, is located immediately in front of the pumping chamber. The plug contains the inlet and exhaust valves. A rebated aperture or well is provided to accommodate the plug and, when fitted into the well, the plug connects the inlet duct and the exhaust duct to the pumping chamber and is located by a twist lock.

The runner therefore has a reduced degree of structural alteration to a standard shoe. In particular, the uppers remain almost standard, the only alteration being the addition of the exhaust stack. In a preferred form, the exhaust stack is molded to fit the curve of the side of the shoe, and pressed into a recess. The valves are replaceable and with the valve plug removed, the shoe may be rinsed and drained.

In the third category referred to above, the footwear is a completely self-contained insert, which includes all working components in the pumping chamber. Thus, this form of the invention may be used in unmodified footwear. The self-contained insert has a smaller pumping chamber of from 25 cm3 to 50 $cm_3$ (1½ $in_3$ to 3 in 3). In many shoes, and sneakers, the existing insole may be removed, to permit fitting of the insert of the present invention.

In one form of insert, the top and bottom of the insert is a thin, flexible plastic sheet with the separation of the top and bottom maintained by using an open structure material such as a non-compressible, open-celled foam, bi-continuous polymer matrix or the like. The nature of such a composition permits free air flow, and yet provides sufficient resilience to expand after compression. A thin flat valve such as a reed valve may be placed under the toe inlet.

Two pumping chambers may be used, one operating in the toe area and the other at the heel. The pumping chambers may have 5 separate air inlets and a shared exhaust stack. The thickness of the insert is preferably between 4 mm and 8 mm (5/32 in and 5/16 in). The pumping chamber at the front of the insert preferably displaces between 7 $cm_3$ and 14 $cm_3$ (1 $in^3$ to 2 $in_3$), during operation. The pumping chamber at the heel preferably displaces the same amount. Both pumping chambers exhaust into the middle section of the insert, via a flat, preferably soft rubber, reed valve, flap valve or such like. Although the inlet for the heel chamber is directly under the heel, the flow of air into the inlet is not hindered, as such flow takes place when the heel is lifted from the ground.

In an alternative embodiment, the insert would have no heel pump, and an increased volume in the toe pump, which also would halve the number of valves, and at the same time put a larger volume of fresh air through the toe area where its benefit will be obvious to a user.

The third category could be extended to include an embodiment having higher volume pumping. The depth of the insert for use in an unmodified shoe, would normally limit the available pumping volume. However, a purpose built range of shoes, which have an upper built to accommodate a deeper insert may be manufactured to allow a boost to the pumping volume and permit the insert to cope with the demands of running and jogging. A blank insert may also be provided.

The insert may be designed to be a part of, even a significant part of, the cushioning of the sole. In such case the cushioning material may be largely replaced by the insert of the present invention which is protected only by the wearing surface of the sole.

The ventilation means may be adapted to induce a cooling effect or a warming effect to the footwear. Cooling being achieved by pumping air from the footwear, that is by exhausting heated compressed air to atmosphere and thus inducing a charge of fresh air to the footwear, and heating being achieved by pumping air into the footwear, that is exhausting heated compressed air into the footwear.

BRIEF DESCRIPTION OF THE DRAWINGS

In order that this invention may be more readily understood and put into practical effect, reference will now be made to the accompanying drawings which illustrate a typical embodiment of the invention and wherein.

DESCRIPTION OF THE PREFERRED EMBODIMENT

Figure 1:
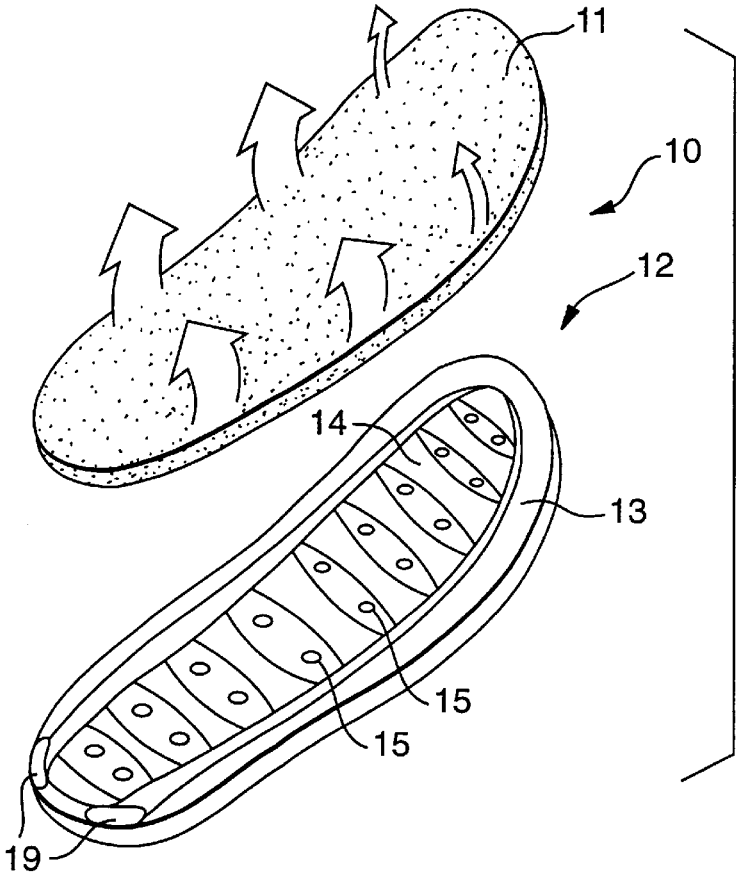
FIG. 1 is an exploded perspective view of one form of ventilating means according to the present invention.
Figure 2:
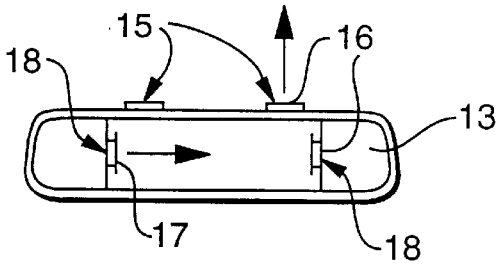
FIG. 2 is a diagrammatic cross-sectional view taken along the line 2—2 of FIG. 1.
Figure 3:
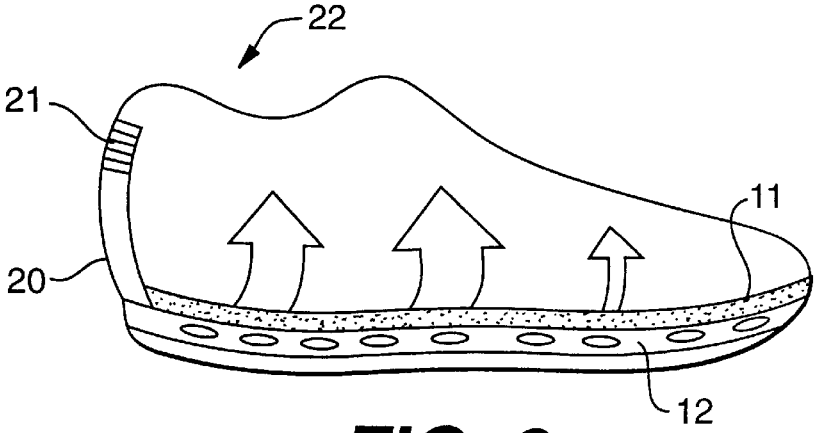
FIG. 3 is a diagrammatic cross-sectional view of another form of footwear incorporating ventilating means of the present invention.

The ventilating means 10 illustrated in FIGS. 1 to 3 is in the form of an insole assembly comprising an upper flow-through pad 11 and a lower pumping assembly 12. The pumping assembly 12 includes a compartmentalized pumping chamber 14 and peripheral air supply chamber 13 extending thereabout. The pumping chamber 14 is provided with a series of air outlets 15 on its upper surface, each of which is associated with a non-return valve such as the flap valves 16. Further non-return 5 valves 17 are supported along the inner wall of the pumping chamber and form controlled inlets 18 through which the pumping chamber communicates with the air supply chamber 13.

The pumping assembly 12 is formed of a resilient plastics material which exhibits elastic recovery after each cycle of compression by foot pressure. The air supply chamber 13 is provided with a pair of air inlets 19 which communicate through snorkel like ducts 20 with filtered air inlets 21 adjacent the upper rear edge of the foot opening 22.

In use, when a user walks or runs a cycle of repeated operations may be commenced resultant from the user's weight upon the sole of the footwear cyclically compressing the pumping chamber 14 and causing air to drawn therein through the inlets 18 and be expelled through the non-return valves 16 for distribution to the interior of the footwear through the flow-through foot pad 11. The pumping chamber 14 expands elastically when the user's weight is removed from the footwear, thus causing air to be induced through the non-return valves 17 from the air supply chambers 13. After air inducement, the non-return valves 17 close the inlets 18 such that on commencement of the next cycle of operations air is once again expelled into the interior of the footwear through the outlets 15.

The supply chamber 13 communicates with the filtered air inlets 21 for air supply from a position elevated above the 30 ground. This is to enable the footwear to be used in damp conditions or in shallow puddles without ingesting water into the pumping chamber.

Figure 4:
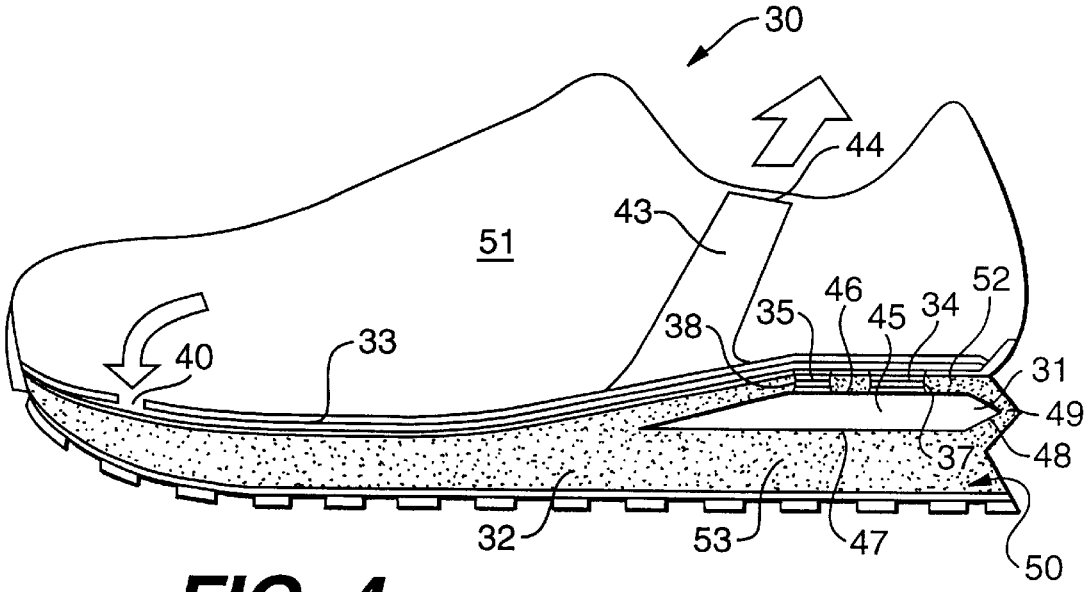
FIG. 4 is a diagrammatic cross-sectional view of a preferred embodiment of the invention.
Figure 5:
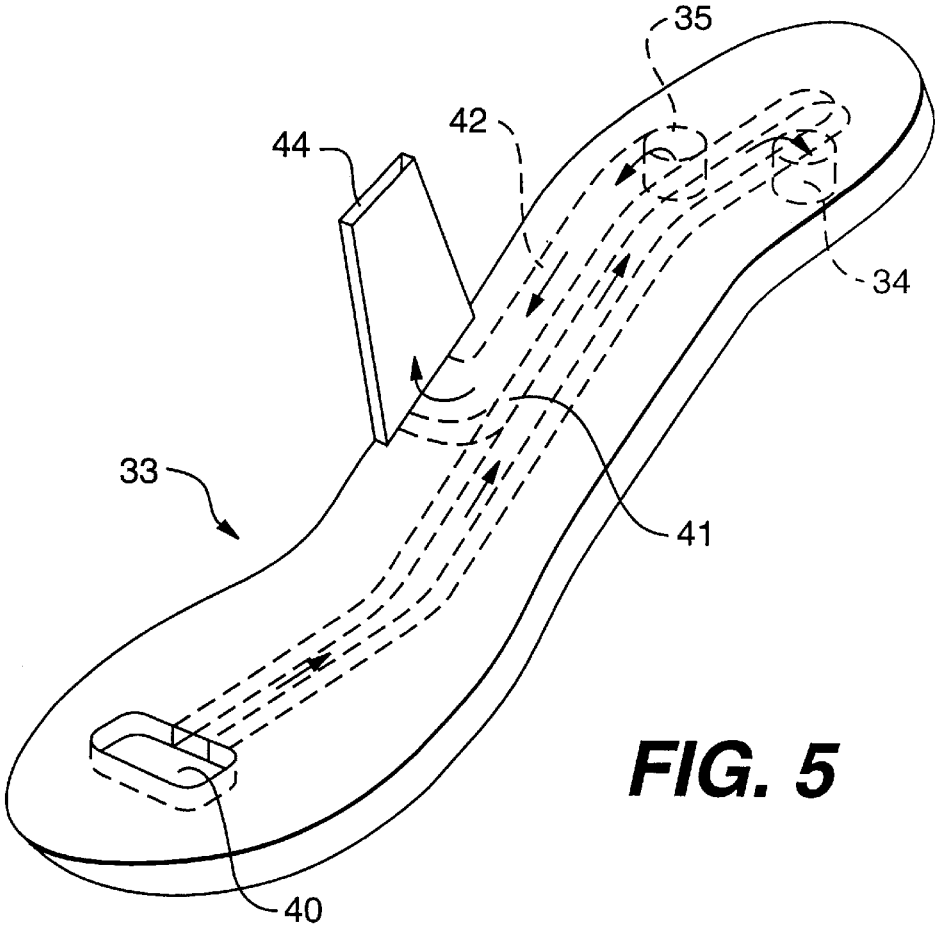
FIG. 5 diagrammatically illustrates the air flow of the preferred embodiment illustrated in FIG. 4.

FIG. 4 illustrates a preferred embodiment of the invention adapted for inducing a cooling air flow through the footwear 30. For this purpose footwear is constructed with an integral pumping chamber 31 molded into the heel section of the sole assembly 32 and adapted to co-operate with a ducted insole 33 through respective inlet and outlet non-return valves 34 and 35. The ducted insole 33 is diagrammatically illustrated in FIG. 5. It is formed as a non-compressible insert having an air inlet 40 beneath the toe region of the shoe, an inlet passage 41 communicating with the non-return inlet valve 34 and an air outlet passage 42 communicating with the non-return exhaust valve 35 and with a flat exhaust tube 43 adapted to extend upwardly along the inside arch of the footwear for exhausting air upwardly through its outlet 44 and away from a user's foot. The outlet 44 may include a filter.

The inside arch portion of the footwear is chosen as there is little pressure on the side of the footwear at this region and thus placement of the exhaust tube 43 at this position should not reduce comfort for a user. Furthermore it will be seen that the passage length between the non-return valves 34 and 35 and the outlet 44 is relatively long. This is provided to damp out and thus reduce the effect the noise emitted from operation of the non-return valves 34 and 35.

It is preferred that the non-return valves 34 and 35 are fixed to the ducted insole 33 such that when it is removed from the footwear the valves 34 and 35 release from their press-seal fit into the inlet aperture 37 and the outlet aperture 38 in the sole assembly 32 for communication with the pumping chamber 31. This allows for easy servicing or replacement of the non-return valves 34/35 as required. Furthermore the insert 25 together with the valves 34/35 may be removed to enable the footwear to be washed and any water drained from the pumping chamber 31 by inverting the footwear.

The pumping chamber 31 is located in the heel portion 50 because of the available thickness of the sole assembly 32 in 30 this area and because of the high pressure that is applied to this part of the sole assembly 32 in use, upon contact with the ground.

The compression chamber includes a central portion 45 having substantially parallel upper and lower walls 46 and 47 and converging upper and lower peripheral walls as illustrated, so as to maintain operative lateral stability of the sole while allowing for substantially parallel movement between the top and bottom walls 46 and 47 between the expanded and compressed attitudes. The converging upper and lower peripheral walls are formed such that the front of the air chamber 31 is of a deep wedge shape whereas the back and side converging walls of the air chamber 31 are of a shallow wedge form and are so formed that the outermost edge 48 maintains a constant distance from the outer face 49 of the sole to provide a substantially even thickness of material supporting the sole assembly 32 above the air chamber 31. The arrangement is such that when compressed the volume of the air chamber 31 approaches zero and the line of the ducted insole straightens along the length of the footwear to substantially conform to the line of a standard sneaker.

In use, impact of the heel portion 50 of the sole assembly 32 will result in rapid compression of air in the air chamber 31 and exhaustion of air through the non-return valve 35 to be exhausted through the outlet via the exhaust tube 43. This rapid compression of air in the air chamber 31 will result in an increase in air temperature but the hot air being exhausted away from the user. As weight is taken from the heel the compression chamber will expand as a result of the natural resilience of the materials forming the heel portion 50 of the sole assembly 32 and air will be induced through the inlet 40 beneath the user's toe through the flow passage 41 via the inlet non-return valve 34. At the end of the induction cycle the non-return valve 34 will close and upon the next impact with the ground the air will again be compressed and exhausted through the outlet 44. In this manner, cool air will be induced into the footwear through the foot opening or if desired through auxiliary openings in the upper portion thereof and cycled via the pumping chamber for exhaust upwardly and away from the footwear.

The uppers 51 may be formed so as to be able to expand and contract slightly in front of the foot opening. It is considered that this will assist in the vertical pumping action of the upper heel 52 relative to the lower heel 53. The non-return valves 34/35 may be of a type in which the effective opening provided thereby may be adjustable or alternatively they may be of the type which may be readily replaced to modify the valve operating characteristics, such as to suit a user's needs. Suitably a slide valve could be provided in the ducted insole at the base of the exhaust non-return valve. The slide valve could be utilized to vary the aperture through which air could be exhausted from the non-return valve into the ducted insole. Furthermore the inside surface of the uppers 51 may include ribs to form air flow paths to assist flow of air to the inlet 40 and past the areas of the foot to be ventilated.

Figure 6:
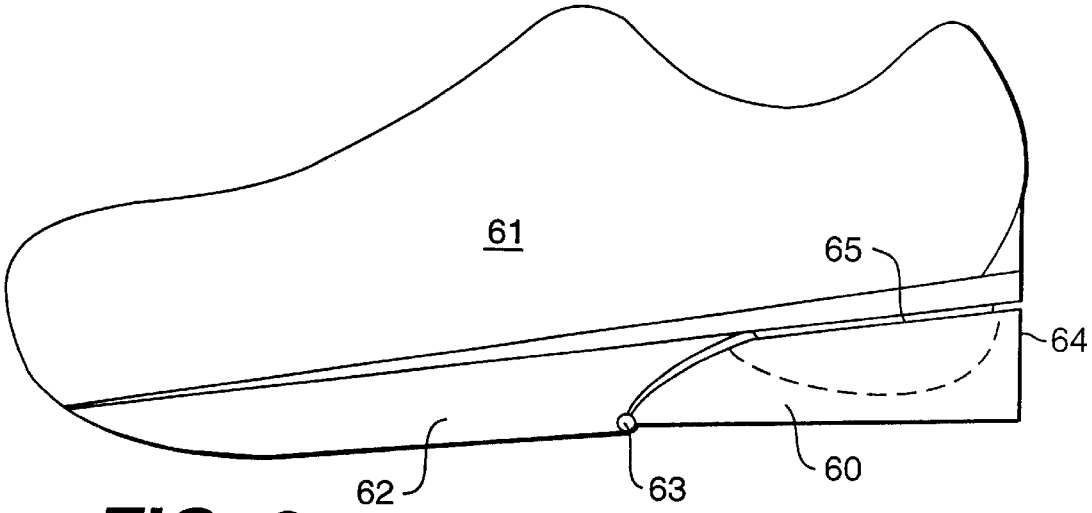
FIGS. 6 to 9 illustrate further embodiments of the invention.

In the embodiment illustrated in FIG. 6 the heel section 60 of the footwear 61 is hingedly attached to the sole assembly 62 by a transverse hinge 63. The heel section contains a recess 64 in its upper surface in which a compressible air bag is supported and co-operating with a complementary protrusion 65 formed in the underside of the sole assembly 62 above the recess 64. Suitable valving means are provided to duct air pumped by the compressible air bag upon cyclic intake and compression resulting from movement of complementary protrusion 65 into the recess 64 at each step and compression of the air bag therein. The air bag may be biassed to an expanded configuration, such as by the movement of the heel section 60 pivotally away from the sole section 62 when user's weight is removed from the footwear.

Figure 7:
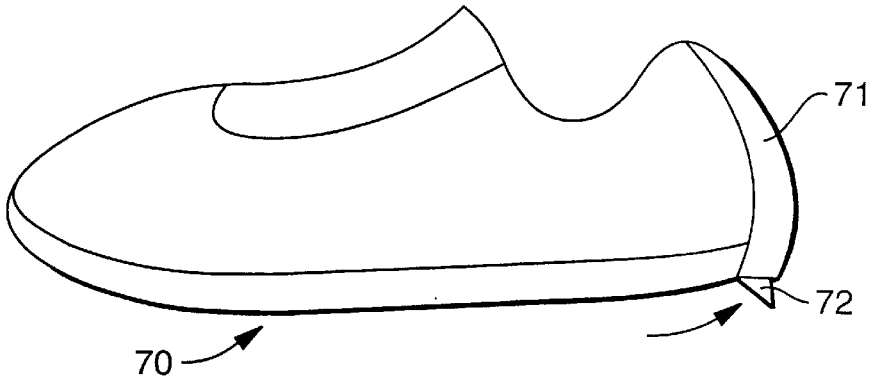

Alternatively as illustrated in FIG. 7 the footwear 70 may include a pumping chamber 71 mounted externally at the rear thereof and including a vertically reciprocable plunger adapted to be forced upwardly into the pumping chamber 71 to cause the required air pumping action. The plunger 72 extends downwardly from the underside of the footwear 70 such that it will be pushed upwardly in a pumping action upon cyclic contact between the footwear and the ground.

Figure 8:
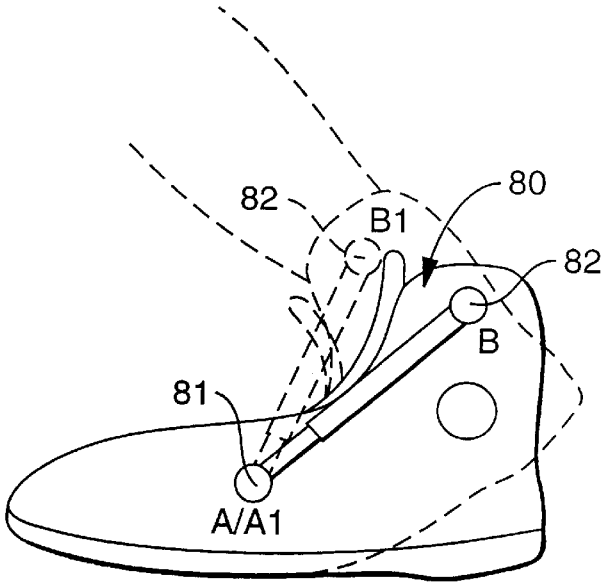

An alternative arrangement is illustrated in FIG. 8 wherein distortion of the footwear in use is utilized to actuate the pumping means. In this embodiment it will be seen that an externally mounted cylinder pump assembly 80 is supported between a fixed lower mounting 81 and a fixed upper mounting 82. When the footwear is distorted to a configuration as shown in dotted outline, as occurs just prior to lifting the foot when walking or jogging, it will be seen that mounting 82 moves upwardly and forwardly relative to the mounting 81 with the result that the distance between the mountings 81 and 82 is cyclically compressed and extended resulting in a pumping action by the cylindrical pump assembly 80.

The characteristics of the footwear which incorporates non-return inlet and outlet valves to a pumping chamber may be operatively varied by either maintaining either or both valves open or closed. Furthermore, the characteristics may be varied by providing a separate and adjustable relief valve for the pumping chamber, by providing additional passages each able to interchangeably communicate with the pumping chamber and selectable to vary the operating characteristics, or by blocking either or both the inlet and outlet passages to the pumping chamber.

Figure 9:
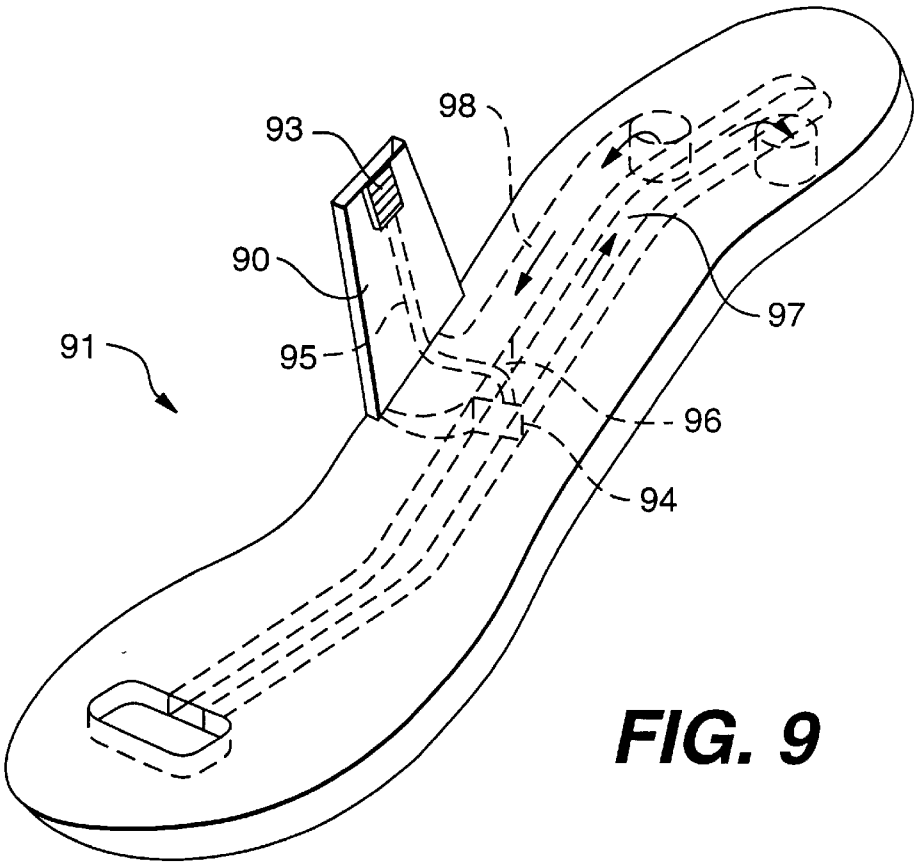
Figure 10:
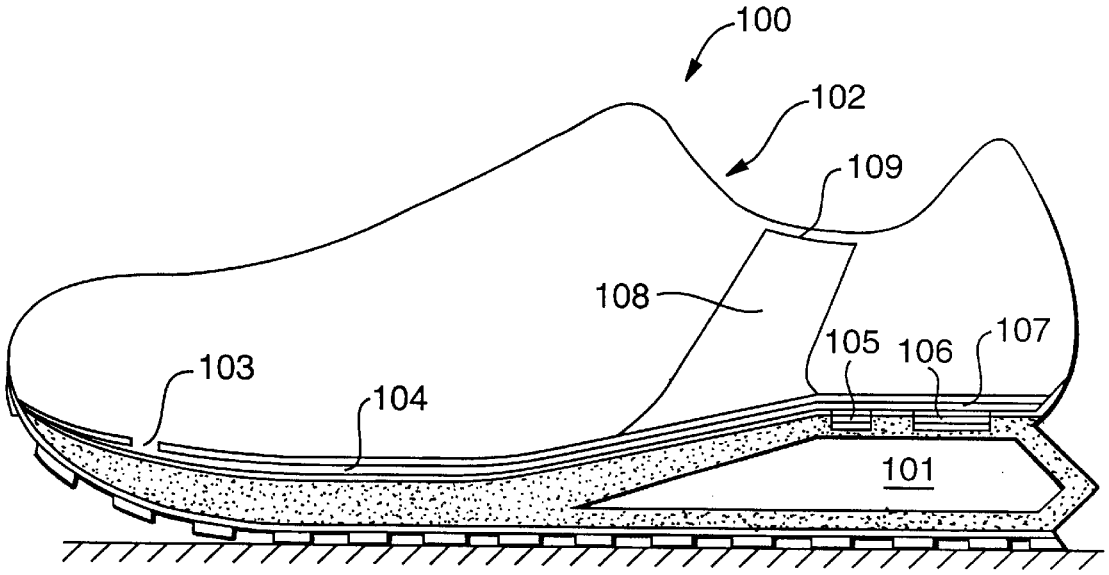
FIG. 10 is a diagrammatic cross-sectional view of another preferred embodiment of the invention.
Figure 11:
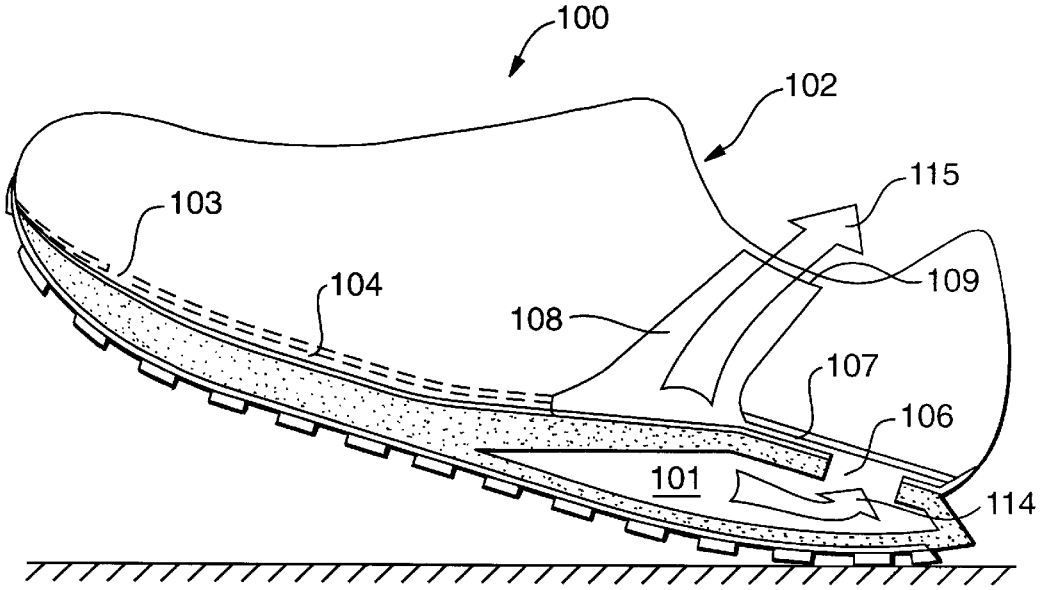
FIGS. 11 to 13 are diagrammatic cross-sectional views of the embodiment of FIG. 10 in use.
Figure 12:
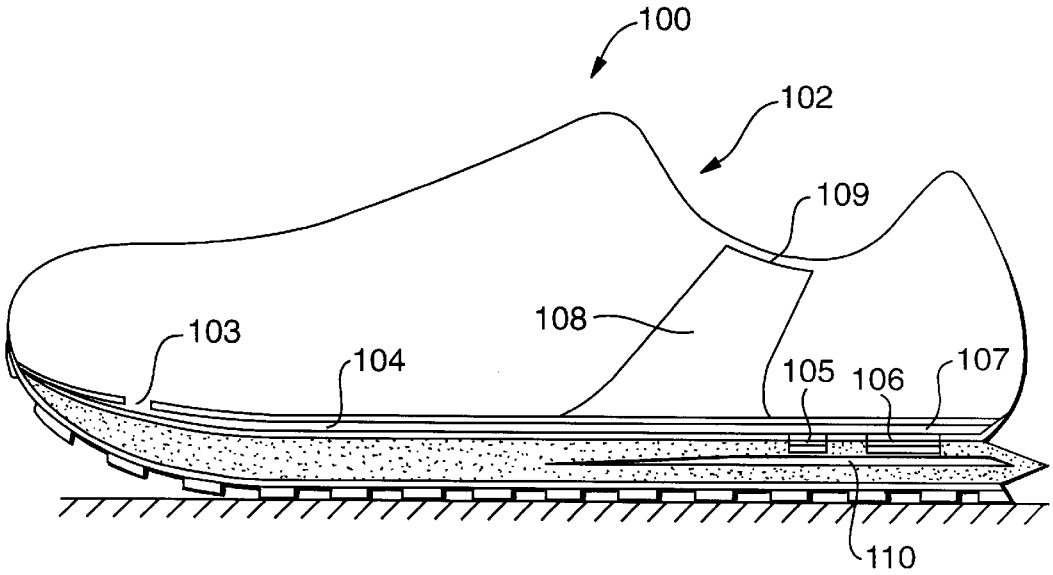
Figure 13:
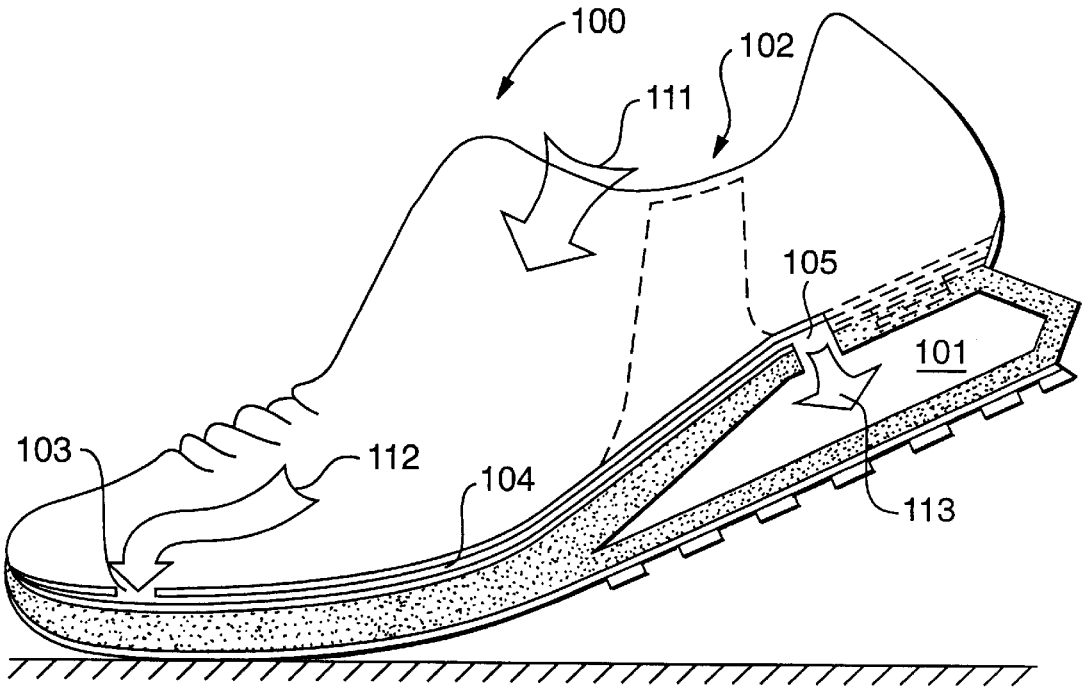

In the embodiment illustrated in FIG. 9 the exhaust tube 90 of the ducted insole 91 is provided with a slide actuator 93 linked to a flap valve 94 by a flexible push/pull cable 95 whereby the flap valve 94 may be moved between a normal position at which it closes an opening 96 interconnecting the inlet passage 97 to the outlet passage 98 and a blocking position at which it blocks flow through the inlet passage 97. When the flap valve is in the normal position the operation is as described with reference to FIG. 6. When the flap valve is in the blocking position, the inlet passage 97 communicates with the outlet passage 98 and air is circulated through the exhaust tube 90.

As mentioned previously the pump assembly may be adapted to induce cooling air into the footwear by arranging the inlet adjacent the toe area and by exhausting to atmosphere.

Alternatively it may be adapted to heat the footwear by exhausting internally of the footwear and taking its inlet from the exterior of the footwear. This is simply achieved by interchanging the inlet and outlet non-return valves.

Referring to FIGS. 10 to 14, a footwear 100 includes a pumping chamber 101 in the heel region. The pumping chamber 100 is connected through an inlet valve 105 to an inlet duct 104 and inlet aperture 103 which provides fluid connection between the inlet duct 104 and the interior of the footwear 100. The pumping chamber 101 is also connected to an outlet valve 106 and outlet duct 107 to an outlet stack 108 and outlet vent opening 109.

The footwear 100 in its inoperative state 141 (shown more particularly in FIG. 10) further includes a foot opening 102 and a pumping chamber biassed to a fully expanded attitude. In a heel strike state 142 (shown more particularly in FIG. 11), air is pumped from the pumping chamber 101 in the direction of arrow 114 through the outlet valve 106, outlet duct 107, outlet 10 stack 108 and outlet vent opening 109 in the direction of arrow 115 by compression of the pumping chamber 101.

The footwear 100 in a loaded state 143 (shown more particularly in FIG. 12) has the pumping chamber 110 collapsed that is exhausted of air by the weight of a user acting on, inter alia, the heel region of the footwear 100.

In a step off state 144 (shown more particularly in FIG. 13), the heel of the footwear 100 is lifted from the ground whilst the toe of the footwear 100 remains in contact therewith. The pumping chamber 101, not being loaded, expands to its biassed state, and in achieving same causes air to be inducted through the foot opening 102 in the direction of arrow 111 through the inlet aperture 103 in the direction of arrow 112, along the inlet duct 104 and through the inlet valve 105 in the direction of arrow 113.

In use, a user wearing footwear 100 on each foot commences in the standing position with both feet on the ground and each respective footwear 100 in the loaded state 143 having a collapsed pumping chamber 110 in each footwear 100. To commence ambulation, one foot is lifted from the ground to move one shoe into the biased state 141 while the other foot causes the footwear 100 on that respective foot to move to the step off state 144.

Figure 17:
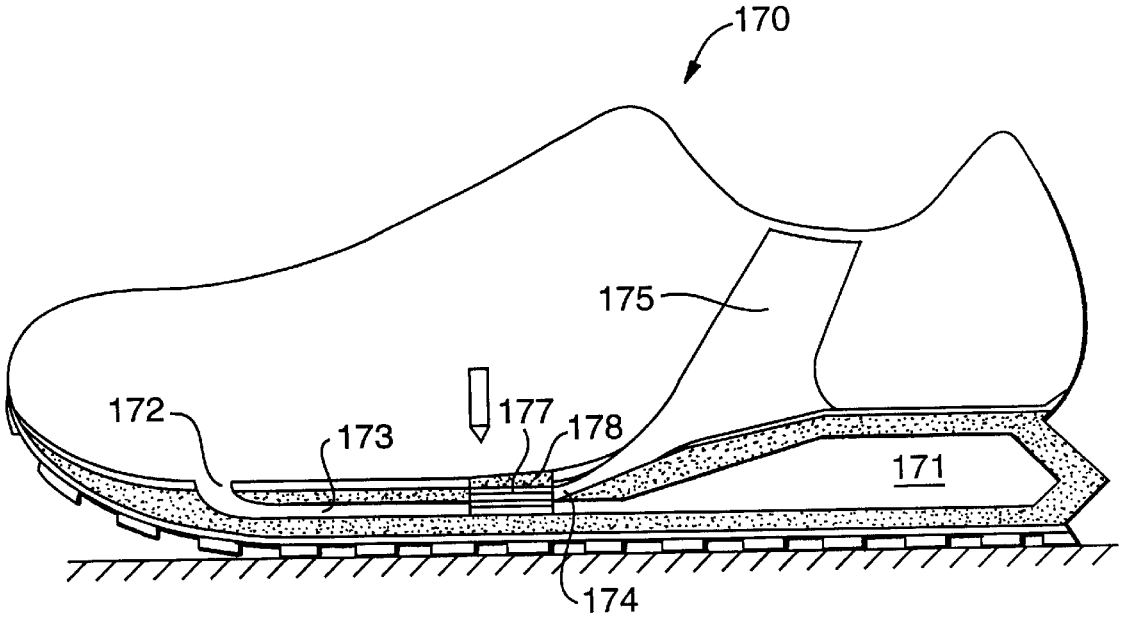
FIG. 17 is a diagrammatic cross-sectional view of a still further preferred embodiment of the invention.

As the user walks, jogs or runs, each foot moves the footwear 100 through a cycle commencing with the step off state 144 where the heel is lifted from the ground and the toe is in contact with the ground, the footwear 100 is then lifted from the ground by which time it has adopted a biased state 141, followed by a heel strike state 141 and loaded state 143 to commence the cycle again. Air is induced in through the foot opening 102 around the ankle and in under the toe through the inlet aperture 103, through the inlet duct 104 and inlet valve 105 to the pumping chamber 101 during expansion of the pumping chamber 101. Thence, upon compression of the pumping chamber 101 during the cycle as described above, air is forced through the outlet valve 106, outlet duct 107, outlet stack 108 and out of the footwear 100 through the outlet vent opening 109 by From the above it will be seen that in use, because of the sequence of operations as described above and because of the forwardly tapering configuration of the pumping chamber in heel, substantially all the air is pressed from the pumping chamber so as the user's foot rolls forward. That is there is substantially no air bypass from one portion of the pumping chamber to another resulting in inefficiency of operation. This may be further assisted by arranging the non-return valves at the leading end of the chamber as illustrated in FIG. 17 with a view to reducing the volume of air compressed each cycle without being expelled from the pumping chamber.

Figure 15:
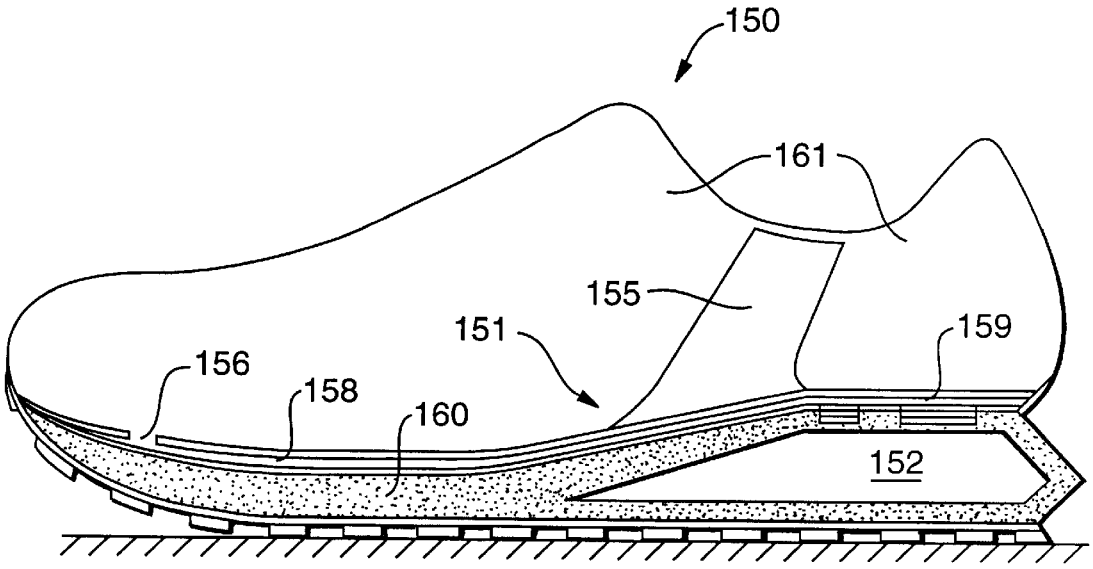
FIG. 15 is a diagrammatic cross-sectional view of a further preferred embodiment of the invention.
Figure 16:
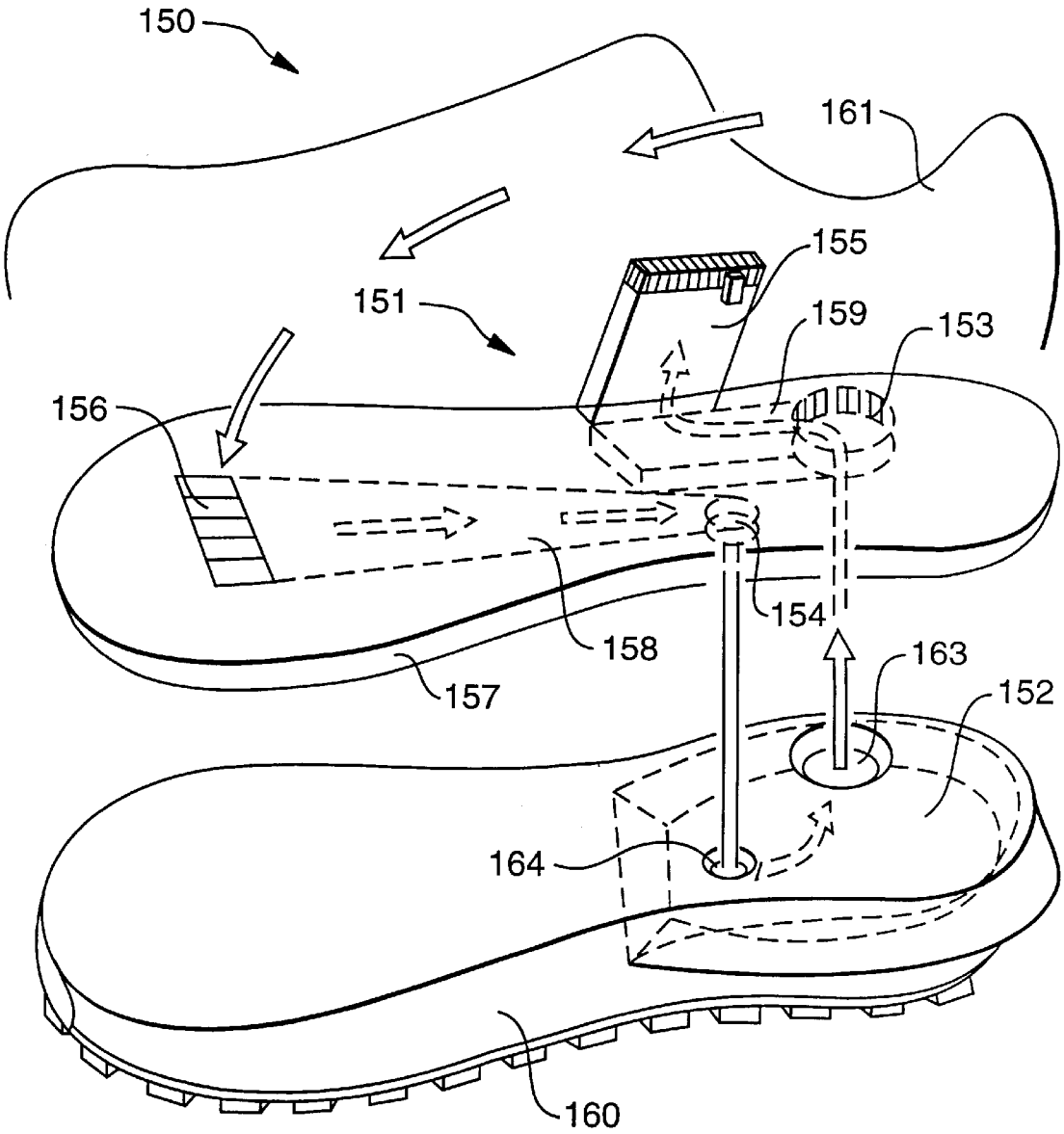
FIG. 16 is a schematic exploded view of the embodiment shown in FIG. 15.

Referring to FIGS. 15 and 16, a footwear 150 is provided with a removable insole assembly 151 for placement inside the footwear 150 which further includes a pumping chamber 152 in a sole portion 160. The pumping chamber 152 has a pump inlet 164 and a pump outlet 163 which align with an inlet valve aperture 154 and an outlet valve aperture 153 in the insole assembly 151 respectively. The inlet valve aperture 154 and outlet valve aperture 153 receive an inlet valve and outlet valve respectively (not shown).

The insole assembly 151 also includes inlet apertures 156 in fluid connection with an inlet duct 158, and an outlet duct 159 in the insole portion 157 in fluid connection with a vent stack 155. The inlet duct 158 is in fluid connection with the inlet valve aperture 154 and the outlet duct 159 is in fluid connection with the outlet valve aperture 153.

Figure 14:
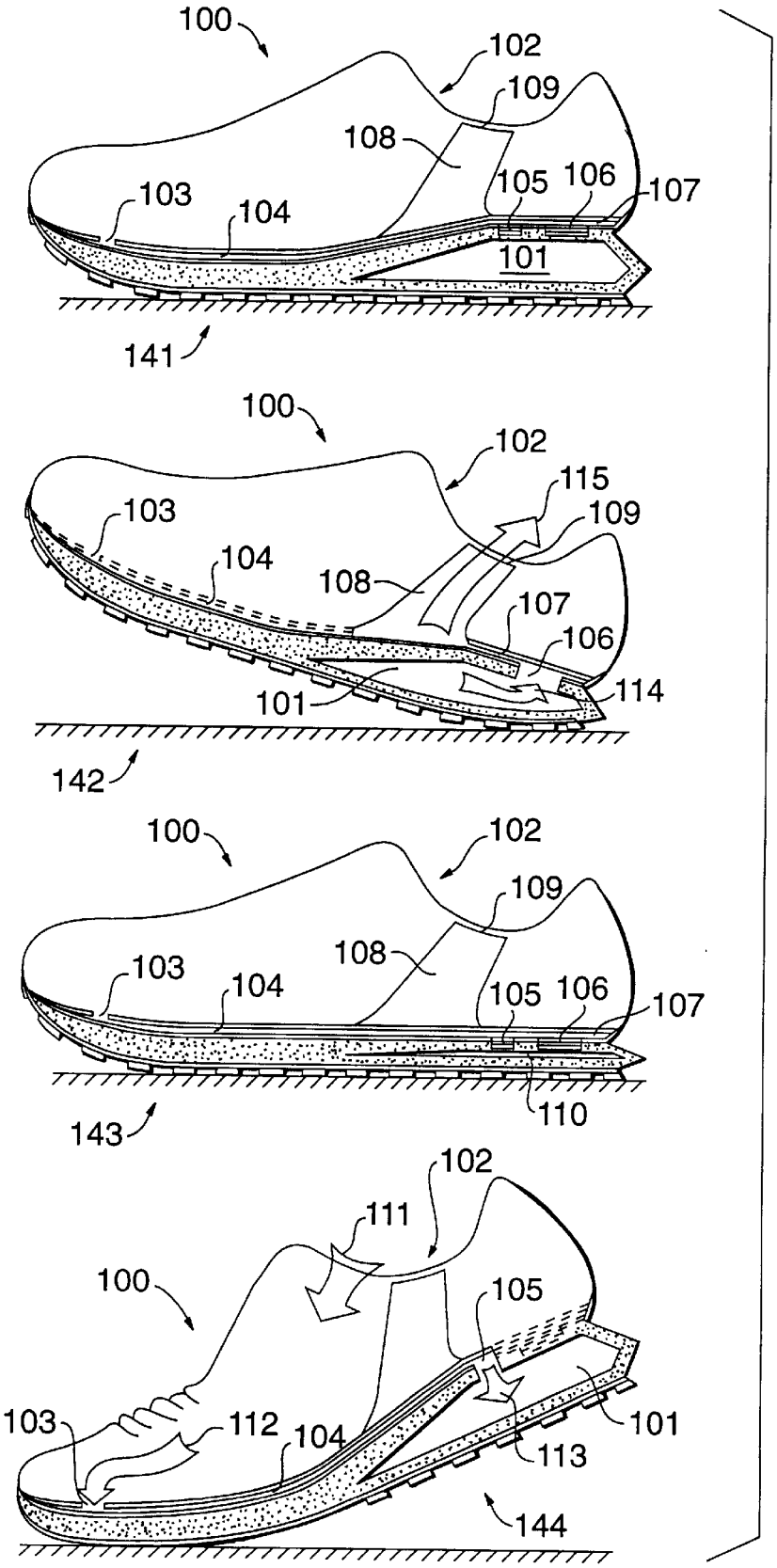
FIG. 14 collectively shows the views of FIGS. 10 to 13.

In use, the footwear 150 goes through a cycle similar to that described in relation to the footwear 100 in FIG. 14, and in the case of the footwear 150 shown in FIG. 16, the air is 18 pumped through the footwear 150 in the direction of the arrows as shown.

Referring to FIG. 17, a footwear 170 has the ventilation assembly of this invention incorporated integrally with the footwear 170. The footwear 170 includes a pumping chamber 171 which connects to an inlet duct 173 through inlet apertures 172 through an inlet valve 176. The pumping chamber 171 is also connected through an outlet valve 177 to an outlet duct 174 and vent stack 175. The inlet valve 176 and outlet valve 177 are isolated from the remainder of footwear 175 a valve assembly cap 178.

In use, air is pumped through the footwear 170 by action of the pumping chamber 171 which receives air through the inlet valve 176, inlet duct 173 and inlet apertures 172 under the toes, or bridge of the toes. Collapsing of the pumping chamber 171 by an applied force thereto expels the air from the pumping chamber 171 through the outlet valve 177 to the outlet duct 174 and vent stack 175.

Figure 18:
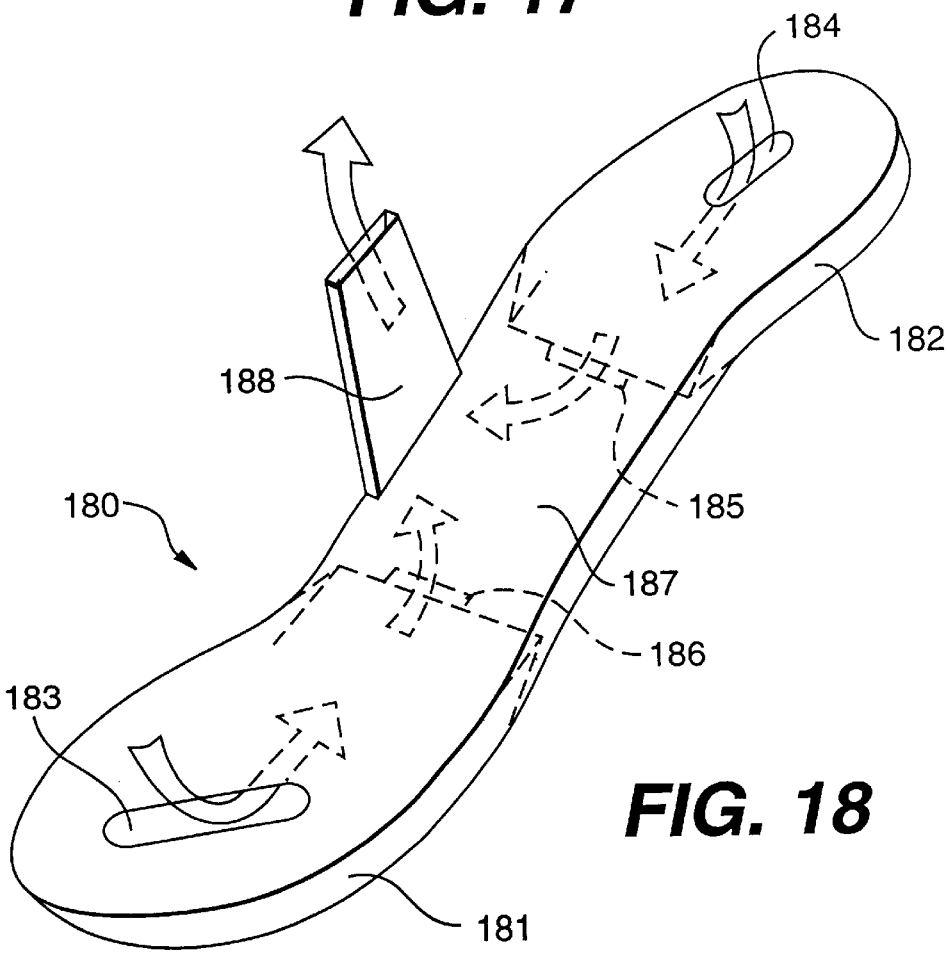
FIG. 18 is a diagrammatic cross-sectional view of yet another further preferred embodiment of the invention.

Referring to FIG. 18, an insole assembly 180 for insertion into footwear includes a forward pumping chamber 181 and a heel pumping chamber 182. The insole assembly 180 further includes a central air transmission portion 187 and vent stack 188.

The forward pumping chamber 181 receive air through a forward inlet 183 having a check valve thereon and the heel pumping chamber 182 has a heel inlet aperture 184 having a check valve incorporated therein. The forward and heel pumping chambers 181 and 182 each have a respective outlet aperture 186 and 185 with a check valve incorporated therein in fluid connection with the air transmission portion 187.

In use, air is inducted into footwear into which the insole assembly 180 is installed as the footwear is used in a normal cycle of walking or running. The inducted air passes through the forward inlet aperture 183 and heel inlet aperture 184 when the forward pumping chamber 181 and heel pumping chamber 182 respectively are decompressed. As the forward pumping chamber 101 is compressed the air is expelled therefrom through the forward outlet aperture 185 and through the vent stack 188. As the heel pumping chamber 182 is compressed, air is expelled through the heel outlet aperture 185 into the air transmission portion 187 and out through the vent stack 188.

Additional Embodiments of the Present Invention

The additional embodiments of the present invention are generally similar to the embodiments described above, i.e., they comprise shoes containing a pumping chamber, wherein air is pumped through the interior of the shoe, and the pumping chamber returns energy as the wearer lifts the shoe off the ground. The material forming the structure of the sides of the pumping chamber also provides a positive bias to the pumping chamber, so that the sides of the chamber also provide energy return when the wearer lifts the shoe off the ground, as the heel begins to lift. The material also forms a wedge shape at the front and rear of the pumping chamber. As the pumping chamber is compressed during use, the top and bottom of the wedge approached the horizontal, and provide lateral stability to the shoe. While the pumping chamber remains compressed, the volume of air in the chamber approaches zero, and the top and bottom of the wedge are close to horizontal.

The objective of the additional embodiments of the present invention is to provide an improved means for providing the returned energy performance, while maintaining side walls sufficiently thin to allow for full chamber compression, and to provide a shoe which is efficient and durable in use.

Although the present invention is illustrated and described with reference to shoes and sneakers, it is to be understood that this by way of example, and that this invention could be used in sports shoes, dress shoes, day shoes, military shoes, and other types of footwear.

Construction of the Pumping Chamber

Figure 19:
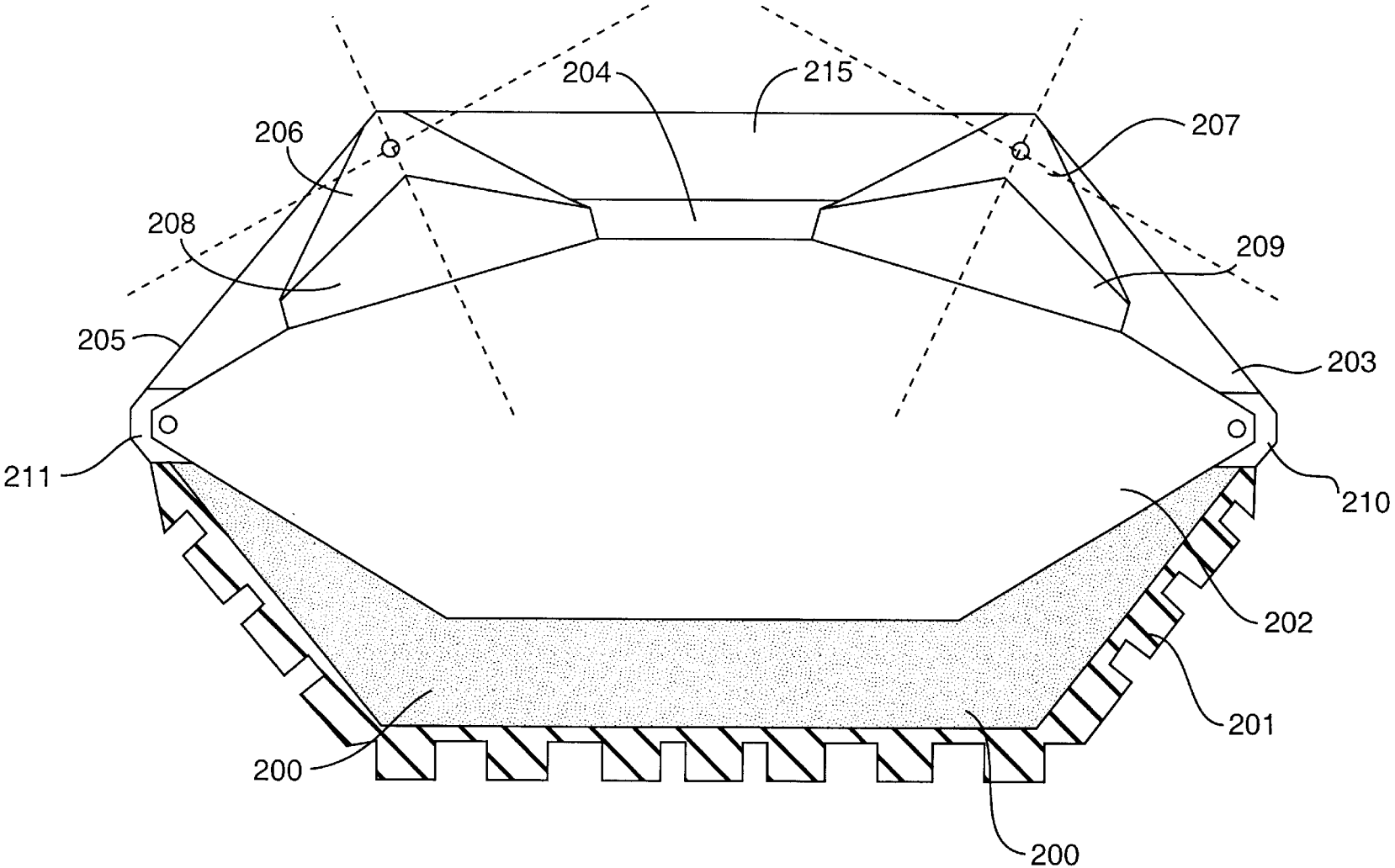
FIG. 19 is a schematic diagram of a lateral cross-section of the pumping chamber of the first additional embodiment of the present invention.
Figure 20:
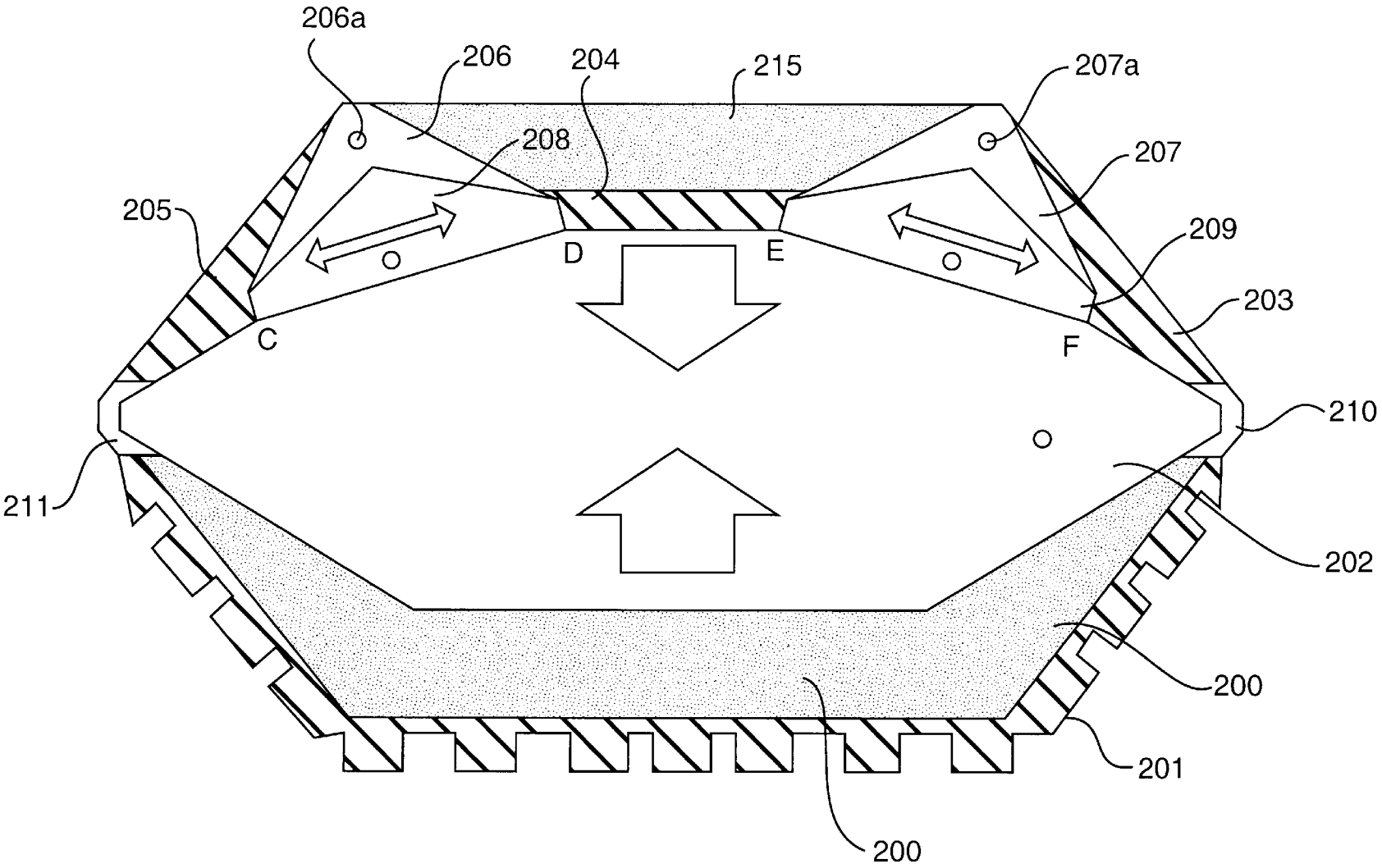
FIG. 20 is a schematic diagram of a lateral cross-section of the pumping chamber shown in FIG. 19, illustrating the operation of the pumping chamber.

A first additional embodiment of the present invention is illustrated schematically in FIGS. 19 and 20. FIGS. 19 and 20 are schematic illustrations of a lateral cross-section of the wedge-shaped pumping chamber. The side elbows 210 and 211 and the top elbows 206 and 207 of the chamber are flexible, such that the elbows operate as a flexible joint, or hinge. The top of the pumping chamber contains three rigid members: rectangular section 204, and side sections 203 and 205. Flexible elbows 206 and 207 allow rigid members 203 and 205 to move towards the horizontal as the pumping chamber is compressed. The top of the chamber also contains sections 208 and 209, which are fabricated from high-energy elastic material, and connect rigid members 205 and 203 to rigid member 204. Trapezoidal section 215 and bottom section 200 are fabricated from a shock-resistant, resilient material. FIGS. 19 and 20 also illustrate the shape of the pumping volume 202. Although FIGS. 19 and 20 also illustrate a tread 201 for the shoe, that tread is shown to complete the schematic diagrams. As pointed out above, the present invention may be used with a variety of different tread patterns and different shoes.

As the pumping chamber is compressed, the lateral extremities tend to move towards the horizontal, with the flexible suspension joint acting as a pivot. As this occurs, the elastic materials is stretched, resisting the compression. When the foot rotates, and the shoe is lifted, the elastic contracts, returning energy to the wearer, and expanding the pumping chamber.

Figure 21:
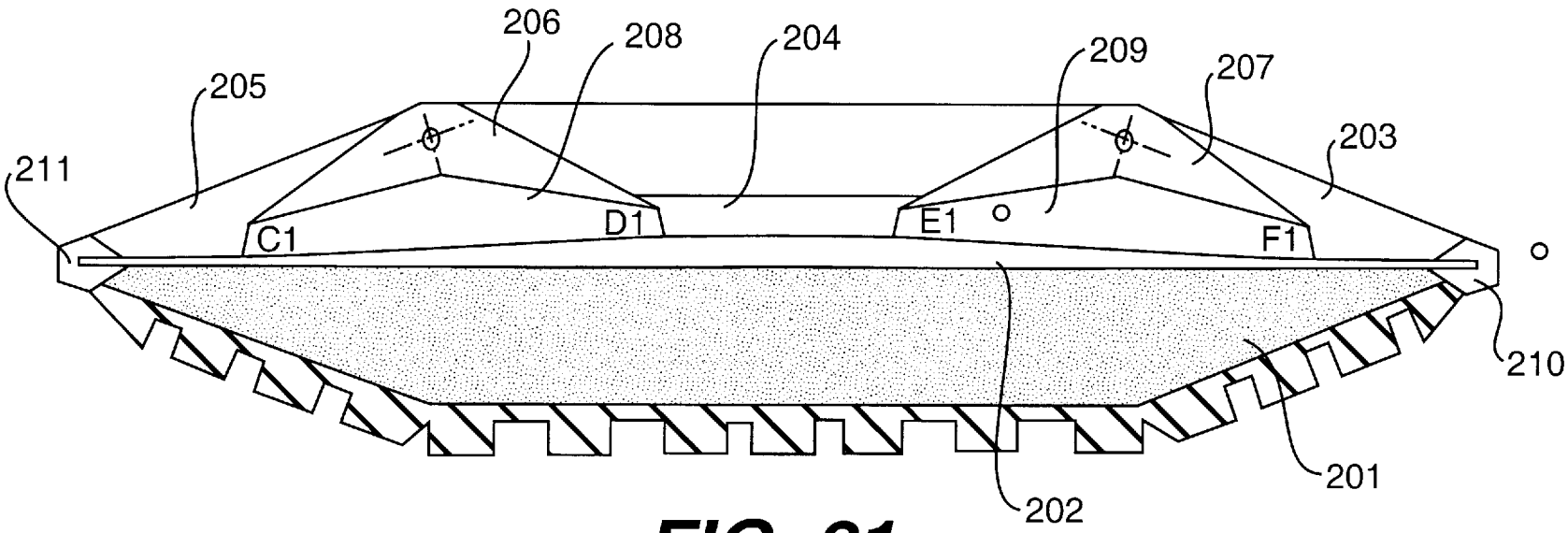
FIG. 21 is a schematic diagram of the pumping chamber of FIG. 21, in a fully collapsed condition.

FIG. 21 illustrates the pumping chamber fully collapsed. As shown in FIG. 21, the high-energy elastic material is fully energized when the pumping chamber is fully collapsed. When the downwards force on the chamber is reduced, as the shoe is rotated forward, the energy stored in the high-energy material is released.

Figure 22:
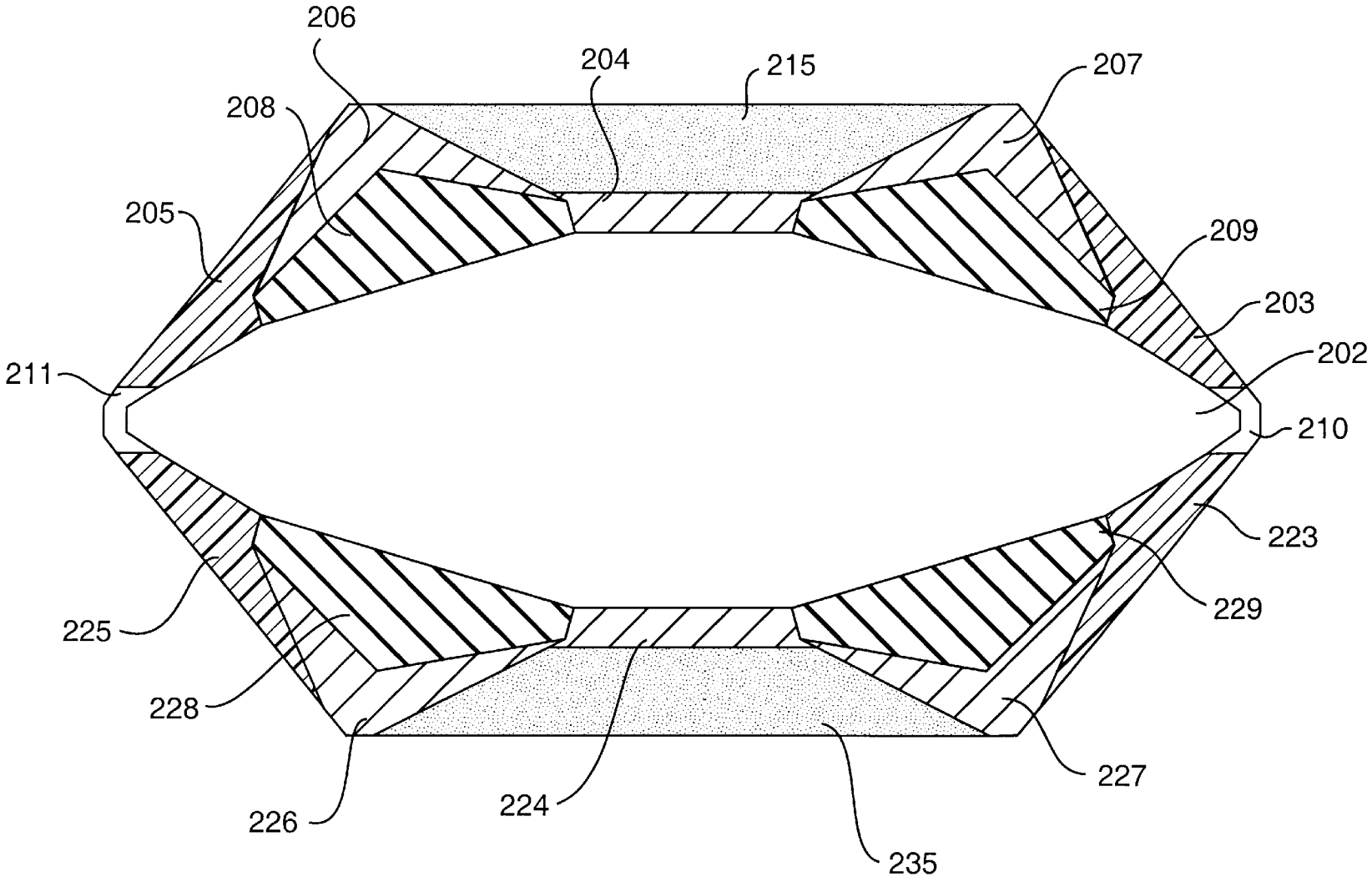
FIG. 22 is a schematic diagram of the lateral cross-section of the pumping chamber of the second additional embodiment of the present invention, at rest.

FIG. 22 illustrates the second additional embodiment of the present invention. This embodiment comprises a pumping chamber with elastic sections 228 and 229 at the bottom of the chamber, in addition to elastic sections 208 and 209 at the top of the chamber. It also includes rigid rectangular section 224, rigid side sections 223 and 225, and flexible joints 226 and 227. The bottom 235 is fabricated from a high-energy, resilient material. The pumping chamber of the second additional embodiment has a greater resistance to compression, and an enhanced energy return efficiency compared to the first additional embodiment.

Figure 23:
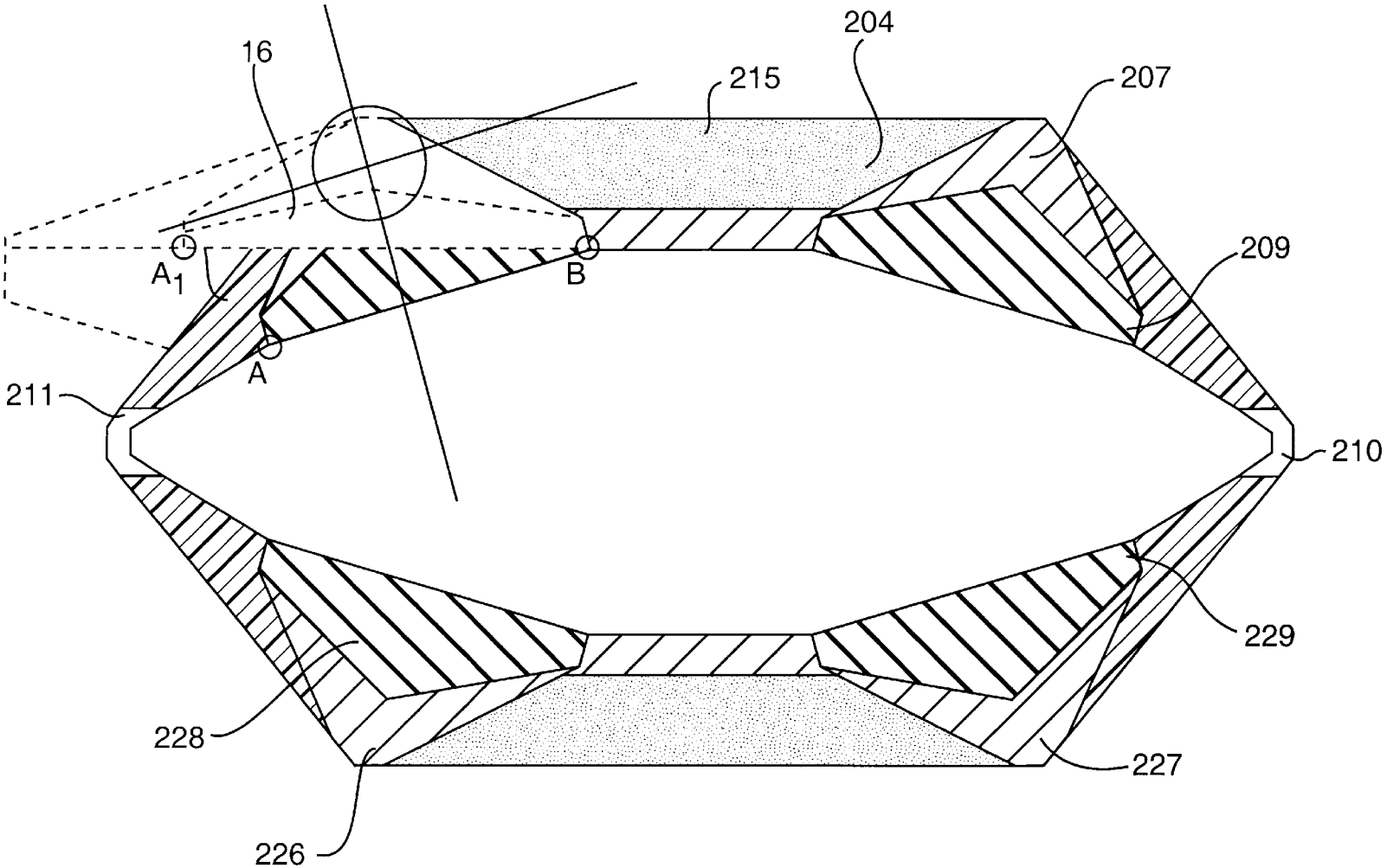
FIG. 23 is a schematic diagram, illustrating the lateral cross-section of FIG. 22 under compression.

FIG. 23 illustrates the chamber of FIG. 22 when it is fully compressed. It is similar to FIG. 22, except that a broken line sketch is included to indicate the outline of the extremity of the chamber when it is fully compressed.

Side-Walls of the Pumping Chamber

Figure 24:
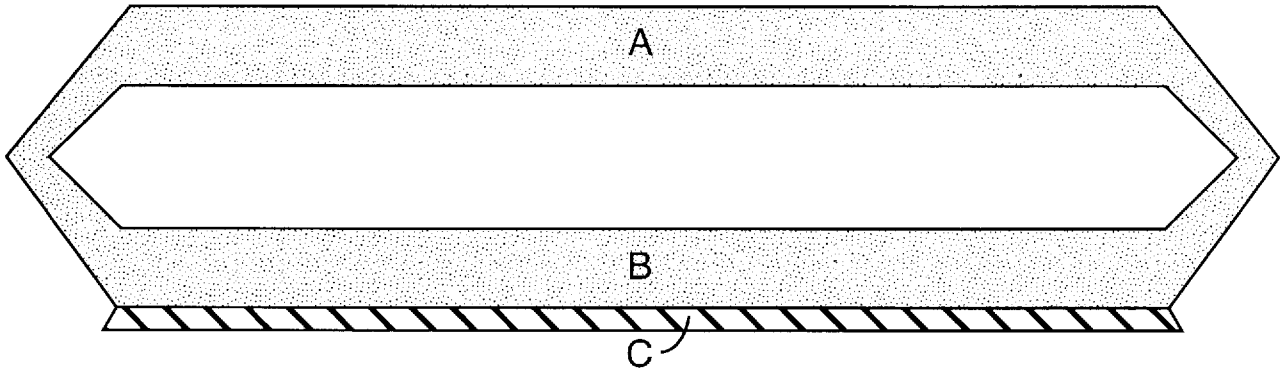
FIGS. 24 and 25 are schematic diagrams of the lateral cross-section of a simple pumping chamber in its uncompressed state and fully compressed state, respectively.
Figure 25:
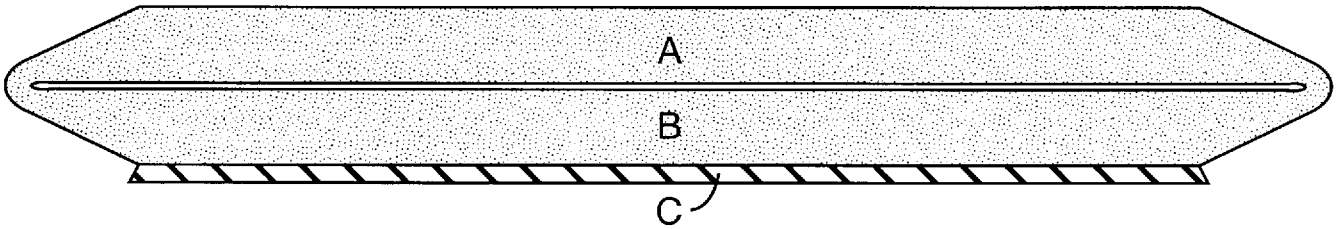

FIGS. 24 and 25 are schematic diagrams of the lateral cross-section of a simple pumping chamber having wedge-shaped lateral extremities, in its uncompressed state (FIG. 24) and fully compressed state (FIG. 25).

Figure 26:
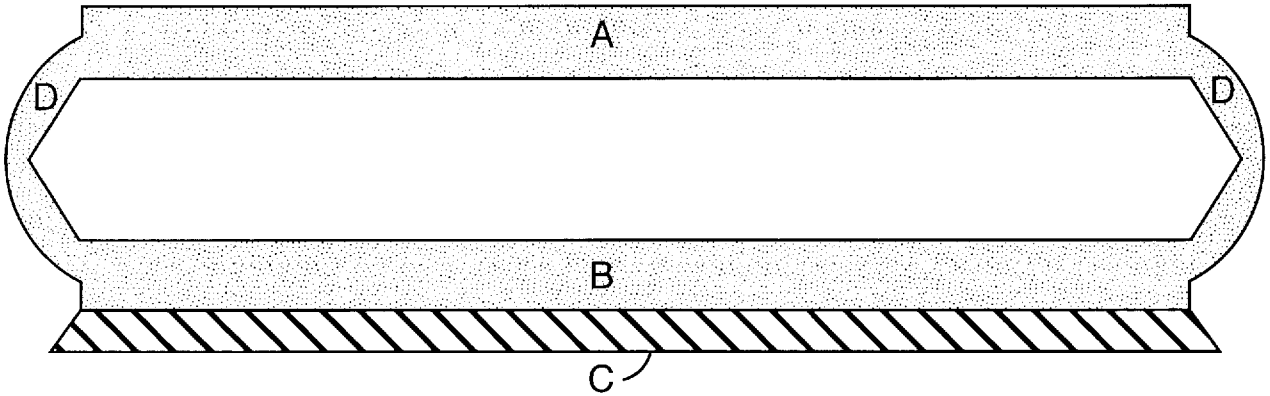
FIGS. 26 and 27 illustrate an alternative construction of the simple pumping chamber, it its uncompressed state and fully compressed state.
Figure 27:
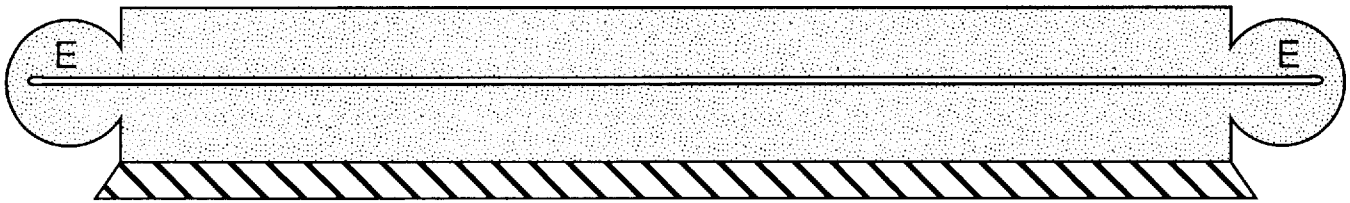

FIGS. 26 and 27 illustrate an alternative construction of a simple pumping chamber, it its uncompressed state (FIG. 26) and fully compressed state (FIG. 27). The alternative embodiment of FIGS. 26 and 27 uses a convex outer surface, such that when the chamber is fully compressed, the outer surface assumes a circular cross-section. This cross-section resists distortions to the pumping chamber and the side walls when they are under compression.

Compressible Tube in the Pumping Chamber

Figure 28:
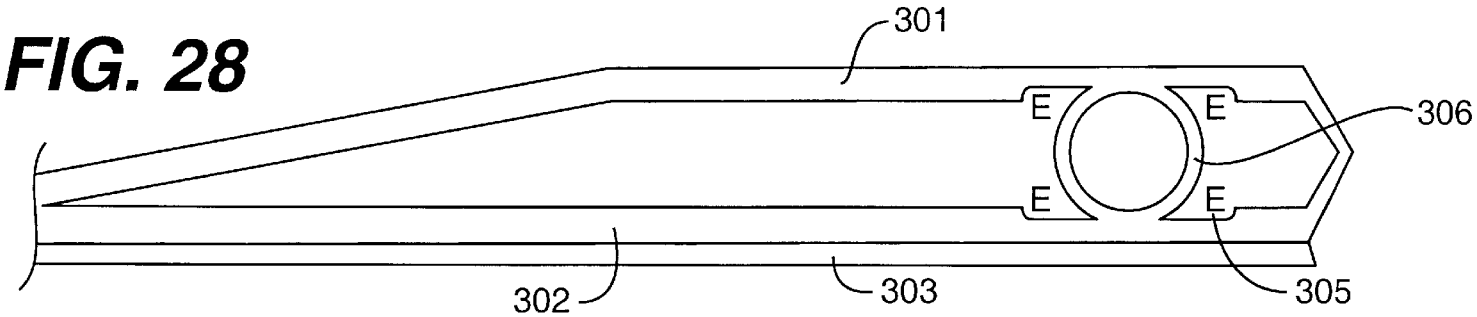
FIGS. 28–31 illustrate the use of a compressible tube in the pumping chamber of the present invention.
Figure 29:
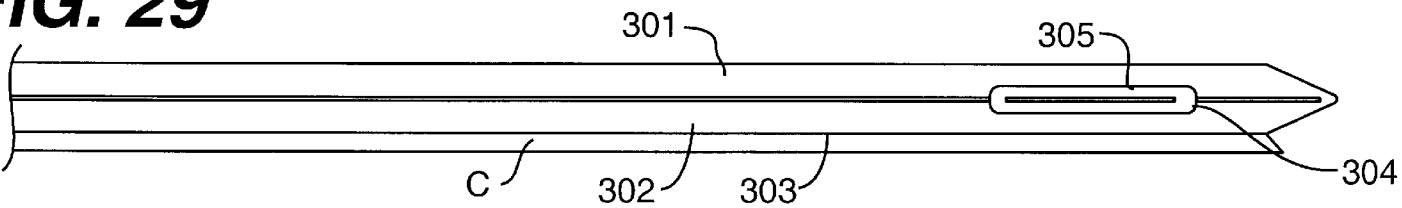
Figure 31:
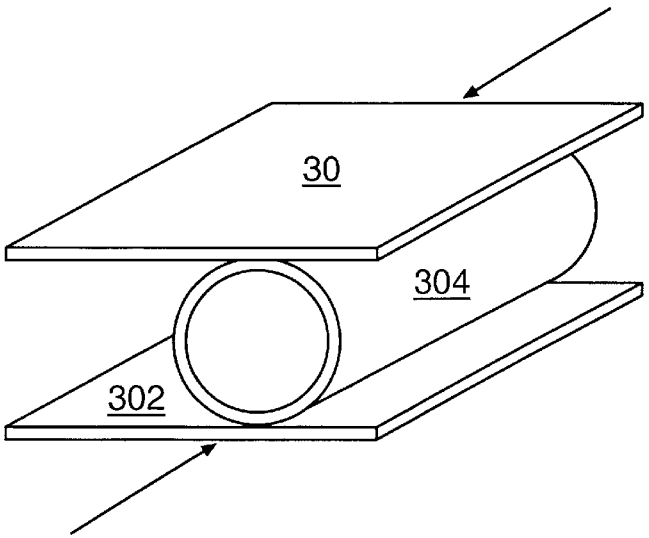
Figure 30:
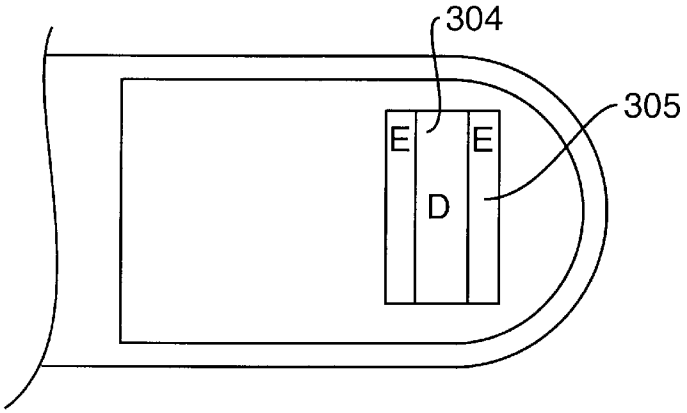

FIGS. 28–31 illustrate the use of a compressible tube in the pumping chamber of the present invention. FIG. 28 shows that compressible tube 304 fits into the rear portion of the pumping chamber, in recesses 305 in the top 301 and bottom 303 of the pumping chamber. FIGS. 28 and 29 also show outsole 303. FIG. 29 shows that when it is fully compressed, compressible tube 304 fits into cavities 305, and prevents the formation of air pockets. FIG. 30 is a plan view of the heel cavity, which shows that the tube does not extend to the side walls, such that air may flow unrestricted into and out of the compressible tube 304. FIG. 31 shows how the use of the compressible tube provides increased resistance to lateral distortion.

Valve Location

Figure 32:
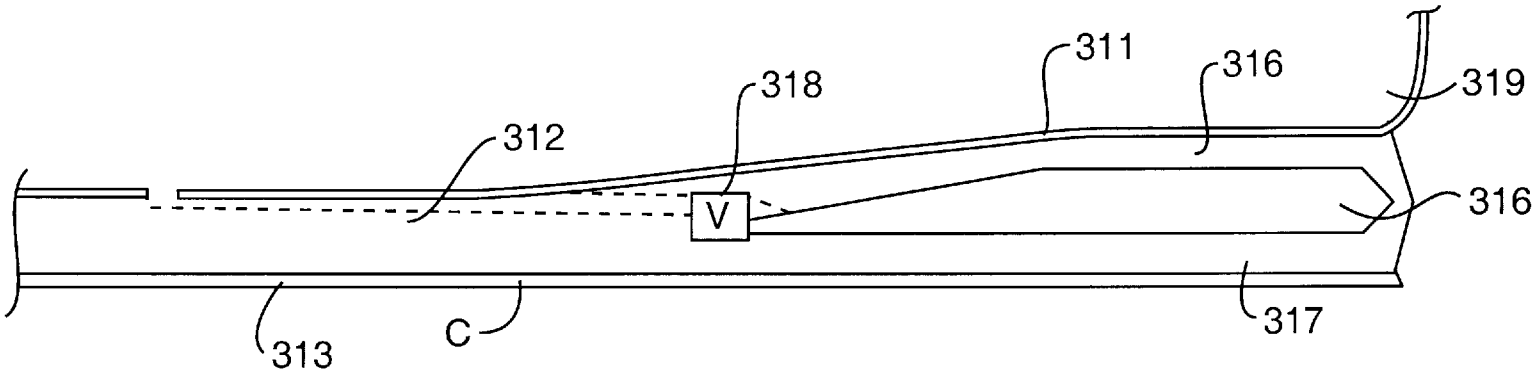
FIGS. 32 and 33 illustrate a preferred location for the air valves of the present invention.
Figure 33:
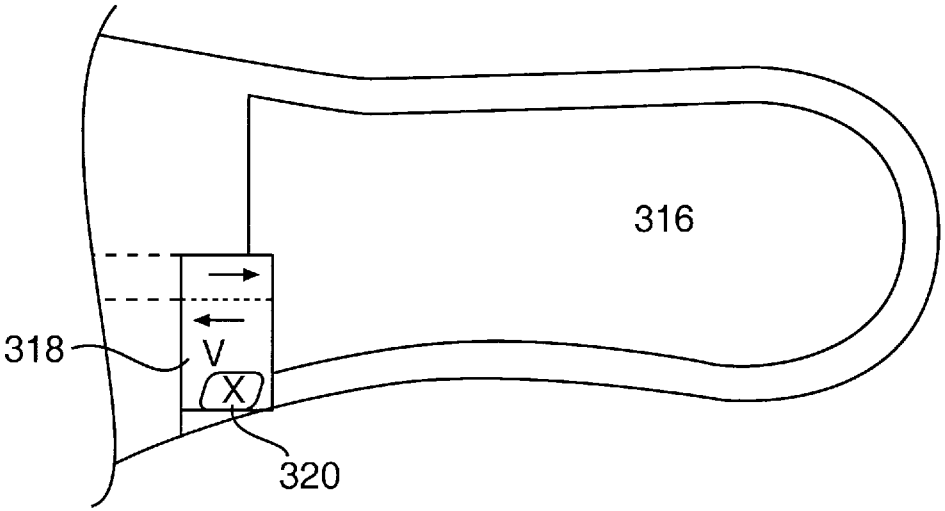

FIGS. 32 and 33 illustrate a preferred location for the air valves of the present invention. FIG. 32 is a longitudinal cross-section showing how air channel 312, from the forward portion of the shoe, leads into pumping chamber 316. FIG. 32 also illustrates insole 311, outsole 313, the top of the pumping chamber 314, the bottom of the pumping chamber 317, the pumping chamber cavity 316, valve 318, shoe 319 and exhaust 320. FIG. 33 is a top view showing air channel 312 connected to the inlet side of valve 318, and exhaust port 320. The valve is located at the instep of the shoe, so that it is accessible from the outside of the shoe.

Valve Configuration

Figure 35:
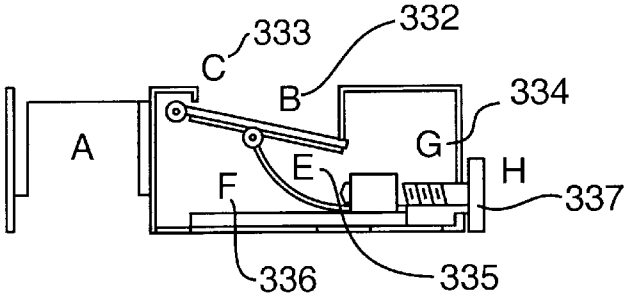
FIG. 35 is a schematic diagram of an improved adjustable valve of the present invention.
Figure 37:
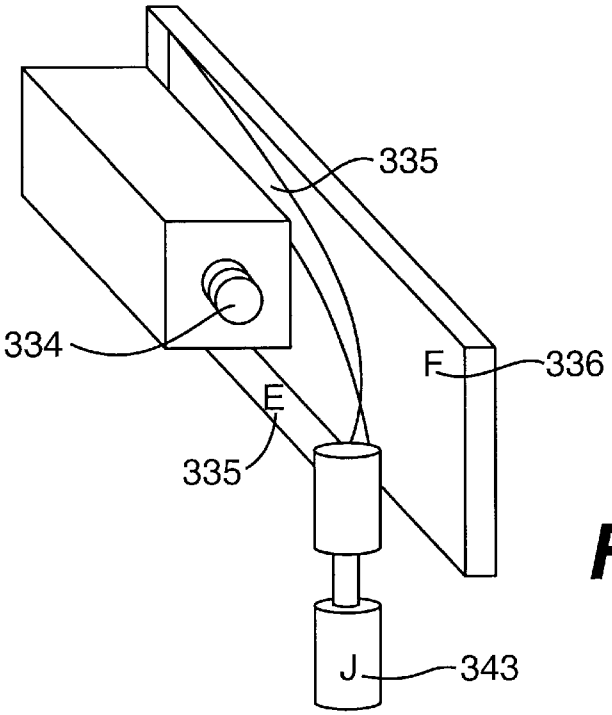
FIGS. 36 and 37 are schematic diagram illustrating details of the valve shown in FIG. 35.
Figure 34:
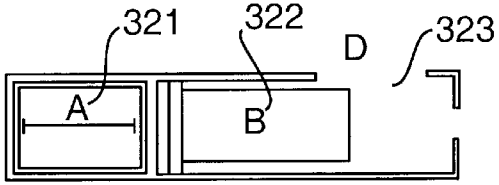
FIG. 34 illustrates the cross-section of a prior art one-way valve.
Figure 36:
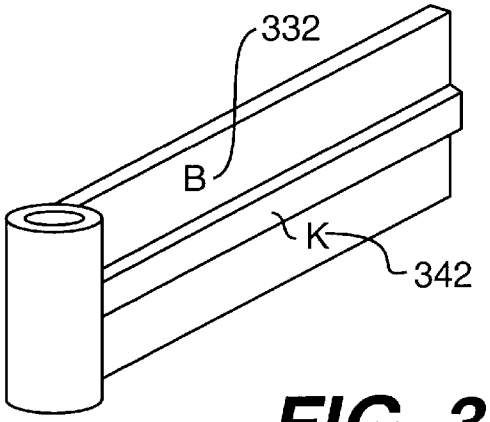

FIG. 34 illustrates the cross-section of a prior art one-way valve, showing its inlet port 321, flap 322, and exhaust port 323. FIG. 35 is a schematic diagram of an improved valve showing flap 332, seat 333 of the flap, tension adjustment screw 334, thumb wheel 337, sliding spring carrier 336, and double leaf spring 335. Spring carrier 336 can be moved to the right, using screw 334, to increase the pressure on flap 332, thus increasing the pressure in the cavity of the pumping chamber. FIG. 36 is a detailed view of flap valve 332, showing locating rib 342. FIG. 37 illustrates the configuration of spring carrier 336 and screw 334 with roller 343, which engages rib 342.

Figure 39:
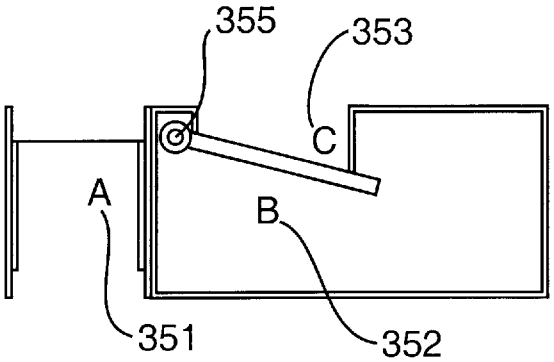
FIGS. 38–40 illustrate an alternative valve configuration.
Figure 38:
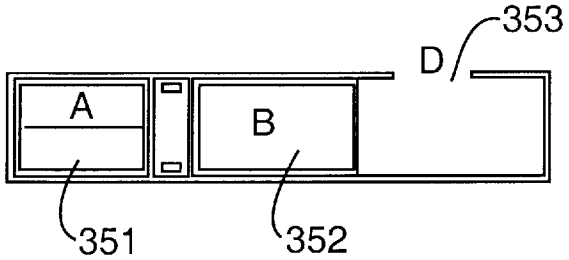
Figure 40:
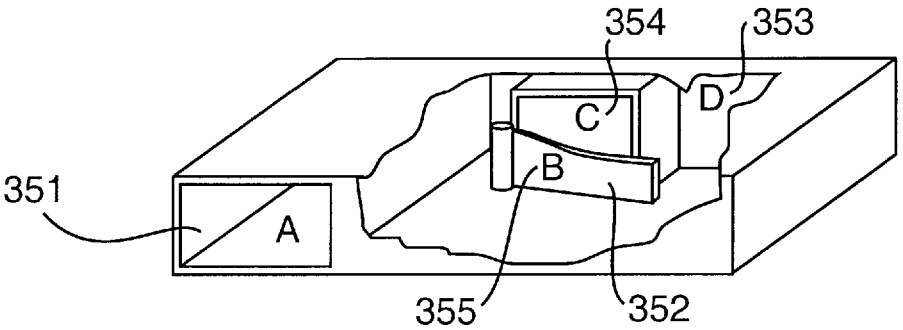

FIGS. 38–40 illustrate an alternative valve configuration. FIG. 38 is a horizontal cross-section showing inlet port 351 with a duck-beak valve, flap valve 352, and exhaust port 353. Air is forced from the cavity through flap-valve opening 354 (illustrated in FIGS. 39 and 40), pushing flap 352 against a spring 355. Air exhausts at near atmospheric pressure via exhaust port 353. FIG. 39 is a plan view showing the operation of flap valve 352 in greater detail. FIG. 40 is a perspective, cut-away diagram of the valve. Spring 355 holding flap valve 352 is illustrated as a coil, but other types of springs may be used, e.g., leaf springs, elliptical springs or other types of springs.

Other Considerations

The ability of the material to return energy can be enhanced by the fact that the chamber is curved around the heel. As a result, the elastic material, as it expands outward during compression, also expands laterally around the curve. Later in the rotation of the shoe, the lateral contraction of the material adds to the energy return efficiency. As the foot begins to lift, the potential energy of the elastic sections will be returned as kinetic energy, assisting the wearer. The return energy has been delivered without the need to overly strengthen and thicken the side walls of the chamber. Of course some return energy is also supplied by the resilient material in the sole section.

The embodiments of the present invention described above are provided for the purposes of explanation and illustration only, and do not limit the invention in any way. The invention should only be limited by the claims appended below.

What we claim is:

1. An energy-return pumping chamber for footwear having:

(a) a lateral cross-section with:

a flat horizontal bottom portion, a flat horizontal top portion, left and right slanted portions on either side of the bottom portion extending symmetrically upwards and outwards from the left and right ends, respectively, of the bottom portion to left and right flexible side elbows, respectively, left and right rigid side sections extending upwards and inwards from the left and right side elbows, respectively, left and right high-energy flexible sections adjacent to the left and right rigid sections, respectively, positioned inwards of the left and right rigid side sections, a rigid rectangular top section forming the flat horizontal top portion of the pumping chamber, joining the left and right flexible sections, a trapezoidal top section fabricated from a shock-absorbing, resilient material;

left and right flexible top elbows on either side of the trapezoidal top section, adjacent to and outwards of the left and right high-energy flexible sections; and (b) a longitudinal cross-section having:

a flat bottom, a rear flat horizontal portion of the top of the pumping chamber, a downward-slanting front portion of the top of the pumping chamber slanting from the forward end of the flat horizontal portion of the top of the pumping chamber down to the forward end of the flat bottom.

* * * * *